US011519106B2

(12) United States Patent
Ridley et al.

(10) Patent No.: US 11,519,106 B2
(45) **Date of Patent: *Dec. 6, 2022**

(54) COILED ACTUATOR SYSTEM AND METHOD

(71) Applicant: Other Lab, LLC, San Francisco, CA (US)

(72) Inventors: Brent Ridley, Huntington Beach, CA (US); Jean Chang, San Francisco, CA (US); Shara Maikranz, Portland, OR (US)

(73) Assignee: OTHER LAB, LLC, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/009,099

(22) Filed: Sep. 1, 2020

(65) Prior Publication Data

US 2020/0399795 A1 Dec. 24, 2020

Related U.S. Application Data

(63) Continuation of application No. 15/949,881, filed on Apr. 10, 2018, now Pat. No. 10,793,979.
(Continued)

(51) Int. Cl.
*D02G 1/20* (2006.01)
*D02G 3/02* (2006.01)
(Continued)

(52) U.S. Cl.
CPC ..... *D02G 1/205* (2013.01); *D02G 1/0286* (2013.01); *D02G 3/02* (2013.01); *D02G 3/326* (2013.01);
(Continued)

(58) Field of Classification Search
CPC ..... D02G 1/20; D02G 1/205; D02G 1/0286; D02G 3/02; D02G 3/326; D02G 3/36;
(Continued)

(56) References Cited

U.S. PATENT DOCUMENTS 2,387,320 A 10/1945 Foster
3,429,758 A 2/1969 Young
(Continued)

FOREIGN PATENT DOCUMENTS

CN 101956271 A 1/2011
CN 104769834 A 7/2015
(Continued)

OTHER PUBLICATIONS

Abel et al., "Hierarchical architecture of active knits," Smart Materials and Structures 22(12):125001, Nov. 1, 2013, 17 pages.
(Continued)

*Primary Examiner* — Ismael Izaguirre
(74) *Attorney, Agent, or Firm* — Davis Wright Tremaine LLP

(57) ABSTRACT

A method of generating a coiled actuator fiber that includes twisting a fiber to generate a twisted fiber; wrapping the twisted fiber around a core yarn or fiber to generate a coil in the twisted fiber, which generates a coiled twisted fiber; setting the coiled twisted fiber by heat or chemical treatment; and removing at least a portion of the core yarn or fiber to generate a coiled actuator fiber.

20 Claims, 19 Drawing Sheets

Related U.S. Application Data

(60) Provisional application No. 62/483,839, filed on Apr. 10, 2017.

(51) Int. Cl.

| | |
|---|---|
| ***D02G 3/36*** | (2006.01) |
| ***D02G 3/38*** | (2006.01) |
| ***D06M 11/05*** | (2006.01) |
| ***D06M 11/84*** | (2006.01) |
| ***D02G 1/02*** | (2006.01) |
| ***D02G 3/32*** | (2006.01) |
| ***D02G 3/40*** | (2006.01) |
| *D06M 101/34* | (2006.01) |
| *D06M 101/20* | (2006.01) |
| *D06M 101/32* | (2006.01) |

(52) U.S. Cl.
CPC ..... *D02G 3/36* (2013.01); *D02G 3/38* (2013.01); *D02G 3/406* (2013.01); *D06M 11/05* (2013.01); *D06M 11/84* (2013.01); *D06M 2101/20* (2013.01); *D06M 2101/32* (2013.01); *D06M 2101/34* (2013.01); *D10B 2321/06* (2013.01); *D10B 2331/02* (2013.01); *D10B 2401/024* (2013.01); *D10B 2401/04* (2013.01); *D10B 2501/00* (2013.01)

(58) Field of Classification Search
CPC ..... D02G 3/38; D02G 3/406; D06M 11/05; D06M 2101/20; D06M 2101/32; D06M 2101/34; D10B 2301/06; D10B 2331/02; D10B 2401/024; D10B 2401/04; D10B 2501/00
See application file for complete search history.

(56) References Cited

U.S. PATENT DOCUMENTS

| | | | | |
|---|---|---|---|---|
| 3,451,305 | A | 6/1969 | Johnson | |
| 3,600,259 | A | 8/1971 | Smith | |
| 3,607,591 | A | 9/1971 | Hansen | |
| 5,127,783 | A | 7/1992 | Moghe et al. | |
| 5,150,476 | A | 9/1992 | Statham et al. | |
| 5,212,258 | A | 5/1993 | Irwin | |
| 5,628,172 | A | 5/1997 | Kolmes et al. | |
| 5,834,093 | A | 11/1998 | Challis et al. | |
| 6,312,784 | B2 | 11/2001 | Russell et al. | |
| 6,458,231 | B1 | 10/2002 | Wapner et al. | |
| 6,767,850 | B1 | 7/2004 | Tebbe | |
| 6,770,579 | B1 | 8/2004 | Dawson et al. | |
| 7,291,389 | B1 | 11/2007 | Bitler et al. | |
| 7,754,626 | B2 | 7/2010 | Baron et al. | |
| 7,976,924 | B2 | 7/2011 | Stanford, Jr. et al. | |
| 8,187,984 | B2 | 5/2012 | Rock | |
| 8,192,824 | B2 | 6/2012 | Rock et al. | |
| 8,349,438 | B2 | 1/2013 | Laib et al. | |
| 8,389,100 | B2 | 3/2013 | Rock et al. | |
| 9,163,334 | B1 | 10/2015 | Fossey et al. | |
| 9,903,350 | B2 | 2/2018 | Li et al. | |
| 10,793,981 | B2 | 10/2020 | Ridley et al. | |
| 2001/0008821 | A1 | 7/2001 | Russell et al. | |
| 2002/0190451 | A1* | 12/2002 | Sancaktar | B29C 70/542 267/166 |
| 2003/0007774 | A1* | 1/2003 | Christopher | G02B 6/245 385/147 |
| 2004/0062910 | A1 | 4/2004 | Morrison | |
| 2004/0266293 | A1 | 12/2004 | Thiriot | |
| 2005/0204449 | A1 | 9/2005 | Baron et al. | |
| 2005/0251900 | A1 | 11/2005 | Harlacker | |
| 2006/0277950 | A1 | 12/2006 | Rock | |
| 2007/0184238 | A1 | 8/2007 | Hockaday et al. | |
| 2009/0176054 | A1 | 7/2009 | Laib et al. | |
| 2011/0052861 | A1 | 3/2011 | Rock | |
| 2013/0078415 | A1 | 3/2013 | Rock | |
| 2013/0247536 | A1 | 9/2013 | Erlendsson et al. | |
| 2014/0004295 | A1 | 1/2014 | Kiederle | |
| 2014/0004332 | A1 | 1/2014 | Kanayama | |
| 2014/0053311 | A1 | 2/2014 | Nordstrom et al. | |
| 2014/0053312 | A1 | 2/2014 | Nordstrom et al. | |
| 2014/0304896 | A1 | 10/2014 | Nordstrom et al. | |
| 2015/0152852 | A1* | 6/2015 | Li | F03G 7/06 60/527 |
| 2016/0017870 | A1 | 1/2016 | Mather | |
| 2016/0340814 | A1* | 11/2016 | Ridley | B32B 5/024 |
| 2021/0025091 | A1 | 1/2021 | Ridley et al. | |

FOREIGN PATENT DOCUMENTS

| | | | |
|---|---|---|---|
| EP | 0900138 | B1 | 1/2002 |
| EP | 3297471 | A4 | 5/2019 |
| JP | H0711535 | A | 1/1995 |
| JP | 2000234231 | A | 8/2000 |
| JP | 2004197259 | A | 7/2004 |
| JP | 2008517183 | A | 5/2008 |
| JP | 2011510180 | A | 3/2011 |
| JP | 2012087449 | A | 5/2012 |
| JP | 2015533521 | A | 11/2015 |
| KR | 20150038475 | A | 4/2015 |
| RU | 2527710 | C1 | 9/2014 |
| WO | 1999005926 | A1 | 2/1999 |
| WO | 2006044210 | A1 | 4/2006 |
| WO | 2009085384 | A1 | 7/2009 |
| WO | 2012086584 | A1 | 6/2012 |
| WO | 2013192531 | A1 | 12/2013 |
| WO | 2014022667 | A2 | 2/2014 |
| WO | 2014138049 | A2 | 9/2014 |
| WO | 2016064220 | A1 | 4/2016 |
| WO | 2016187547 | A1 | 11/2016 |
| WO | 2016202813 | A1 | 12/2016 |
| WO | 2017058339 | A2 | 4/2017 |
| WO | 2017096044 | A1 | 6/2017 |
| WO | 2017165435 | A3 | 12/2017 |

OTHER PUBLICATIONS

Abel, "Active Knit Actuation Architectures," Doctoral dissertation, University of Michigan, Mar. 2014, 161 pages.

Arghyros et al., "Mechanics of Texturing Thermoplastic Yarns. Part VIII: An Experimental Study of Heat Setting," Textile Research Journal 52(5):295-312, May 1982.

Beresford et al., "The Effect of Tension and Annealing on the X-ray Diffraction Pattern of Drawn 6.6 Nylon," Polymer 5:247-256, Jan. 1, 1964.

Buckley et al., "19—Heat-Setting of Drawn Polymeric Fibres: Anomalous Twist Recovery," The Journal of the Textile Institute 76(4):264-274, Jul. 1, 1985.

Buckley et al., "High-temperature viscoelasticity and heat-setting of poly(ethylene terephthalate)," Polymer 28 (1):69-85, first disclosed Apr. 1982, print publication Jan. 1, 1987.

Chen et al., "Electromechanical Actuator Ribbons Driven by Electrically Conducting Spring-Like Fibers," Advanced Materials 27(34):4982-4988, Sep. 1, 2015.

Chen et al., "Hierarchically arranged helical fibre actuators driven by solvents and vapours," Nature Nanotechnology 10(12):1077-1083, plus Supplementary Notes, published online Sep. 14, 2015, print publication Dec. 2015, 50 pages.

Cherubini et al., "Experimental characterization of thermally-activated artificial muscles based on coiled nylon fishing lines," AIP Advances 5(6):067158, Jun. 2015, 12 pages.

Decristofano et al., "Temperature-adaptive Insulation Based on Multicomponent Fibers of Various Cross-sections," MRS Proceedings 1312:137-142, Jan. 2011.

Extended European Search Report for Application No. 18785006.0 dated Nov. 19, 2020, 8 pages.

Fossey et al., "Variable Loft Thermal Insulation for Temperature Adaptive Clothing," Solutions and Opportunities for the Safety and Protective Fabrics Industry, 4th International Conference on Safety and Protective Fabrics, Oct. 26, 2004, 18 pages.

(56) References Cited

OTHER PUBLICATIONS

Gupta et al., "Structure-Property Relationship in Heat-Set Poly(ethylene Terephthalate) Fibers. I. Structure and Morphology," Journal of Applied Polymer Science 29(10):3115-3129, Oct. 1984.
Gupta et al., "Structure-Property Relationship in Heat-Set Poly(ethylene Terephthalate) Fibers. II. Thermal Behavior and Morphology," Journal of Applied Polymer Science 29(12):3727-3739, Dec. 1984.
Gupta et al., "Structure-Property Relationship in Heat-Set Poly(ethylene Terephthalate) Fibers. III. Stress-Relaxation Behavior," Journal of Applied Polymer Science 29(12):4203-4218, Dec. 1984.
Gupta et al., "Structure-Property Relationship in Heat-Set Poly(ethylene Terephthalate) Fibers. IV. Recovery Behavior," Journal of Applied Polymer Science 29(12):4219-4235, Dec. 1984.
Gupta et al., "The Effect of Heat Setting on the Structure and Mechanical Properties of Poly(ethylene Terephthalate) Fiber. I. Structural Changes," Journal of Applied Polymer Science 26(6):1865-1876, Jun. 1981.
Gupta et al., "The Effect of Heat Setting on the Structure and Mechanical Properties of Poly(ethylene Terephthalate) Fiber. II. The Elastic Modulus and Its Dependence on Structure," Journal of Applied Polymer Science 26(6):1877-1884, Jun. 1981.
Gupta et al., "The Effect of Heat Setting on the Structure and Mechanical Properties of Poly(ethylene Terephthalate) Fiber. III. Anelastic Properties and Their Dependence on Structure," Journal of Applied Polymer Science , 26(6):1885-1895, Jun. 1981.
Gupta et al., "The Effect of Heat Setting on the Structure and Mechanical Properties of Poly(ethylene Terephthalate) Fiber. IV. Tensile Properties Other Than Modulus and Their Dependence on Structure," Journal of Applied Polymer Science 26(6):1897-1905, Jun. 1981.
Haines et al., "Artificial Muscles from Fishing Line and Sewing Thread," Science 343(6173):868-872, and Supplementary Materials, Feb. 21, 2014, 41 pages.
Hearle et al., "32-The Snarling of Highly Twisted Monofilaments. Part I: The Load-Elongation Behavior with Normal Snarling," The Journal of the Textile Institute 63(9):477-489, Sep. 1972.
Hearle et al., "33-The Snarling of Highly Twisted Monofilaments. Part II: Cylindrical Snarling," The Journal of the Textile Institute 63(9):490-501, Sep. 1972.
Hiraoka et al., "Power-efficient low-temperature woven coiled fibre actuator for wearable applications," Scientific Reports 6:36358, plus Supplementary Information, Nov. 4, 2016, 16 pages.
Hsu et al., "A dual-mode textile for human body radiative heating and cooling," Science Advances 3(11):e1700895, Nov. 10, 2017, 9 pages.
Hsu et al., "Personal Thermal Management by Metallic Nanowire-Coated Textile," Nano Letters 15(1):365-71, online publication Nov. 30, 2014, print publication Dec. 3, 2014.
Hsu et al., "Radiative human body cooling by nanoporous polyethylene textile," Science 353(6303):1019-1023, plus Supplementary Material, Sep. 2, 2016, 25 pages.
International Search Report and Written Opinion dated Aug. 30, 2018, International Patent Application No. PCT/US 2018/026941, filed Apr. 10, 2018.
International Search Report and Written Opinion dated Jun. 26, 2019, Patent Application No. PCT/US2019/020756, filed Mar. 5, 2019, 7 pages.
International Search Report and Written Opinion dated Oct. 6, 2016, International Patent Application No. PCT/US2016/033545, filed May 20, 2016.
Kianzad et al., "Nylon coil actuator operating temperature range and stiffness," SPIE 9430, Electroactive Polymer Actuators and Devices (EAPAD) 2015, Apr. 29, 2015, 6 pages.
Kianzad, "A Treatise on Highly Twisted Artificial Muscle: Thermally Driven Shape Memory Alloy and Coiled Nylon Actuators," Master's Thesis, University of British Columbia, Aug. 2015, 98 pages.
Kim et al., "Bio-inspired, Moisture-Powered Hybrid Carbon Nanotube Yam Muscles," Scientific Reports 6:23016, Mar. 14, 2016, 7 pages.
Kim et al., "Dynamic Extension-Contraction Motion in Supramolecular Springs," Journal of the American Chemical Society 129(36):10994-10995, Sep. 12, 2007.
Kunugi et al., "Mechanical properties and superstructure of high-modulus and high-strength nylon-6 fibre prepared by the zone-annealing method," Polymer 23(8):1199-1203, Jul. 1, 1982.
Lee et al., "High performance electrochemical and electrothermal artificial muscles from twist-spun carbon nanotube yarn," Nano Convergence 2(1):8, Dec. 1, 2015, nine pages.
Maziz et al., "Knitting and weaving atlincial muscles," Science Advances 3(1):e1600327, Jan. 25, 2017.
Melvinsson, "Textile Actuator Fibres: Investigation in materials and methods for coiled polymer fibre muscles," Master's Thesis, The Swedish School of Textiles, University of Borås, Jun. 8, 2015, 60 pages.
Moretti et al., "Experimental characterization of a new class of polymeric-wire coiled transducers," Behavior and Mechanics of Multifunctional Materials and Composites 2015 9432:94320P, Apr. 1, 2015, 9 pages.
Murthy et al., "Effect of annealing on the structure and morphology of nylon 6 fibers," Journal of Macromolecular Science, Part B: Physics 26(4):427-446, Dec. 1, 1987.
Neukirch et al., "Writhing instabilities of twisted rods: from infinite to finite length," Journal of the Mechanics and Physics of Solids 50(6):1175-1191, Jun. 1, 2002.
Ogulata, "Air Permeability of Woven Fabrics," Journal of Textile and Apparel, Technology and Management, 5(2):1-10, Jan. 2006.
Park et al., "Structure changes caused by strain annealing of nylon 6 fibers," Journal of Macromolecular Science, Part B: Physics 15(2):229-256, May 1, 1978.
Prevorsek et al., "Effect of Temperature and Draw Ratio on Force-Extension Properties of Twisted Fibers," Textile Research Journal 35(7):581-587, Jul. 1965.
Raviv et al., "Active Printed Materials for Complex Self-Evolving Deformations," Scientific Reports 4:7422, Dec. 18, 2014, 8 pages.
Sharafi et al., "A multiscale approach for modeling actuation response of polymeric artificial muscles," Soft Matter, 11(19):3833-3843, Mar. 30, 2015.
Statton, "High-Temperature Annealing of Drawn Nylon 66 Fibers," Journal of Polymer Science Part B: Polymer Physics 10(8):1587-1592, Aug. 1, 1972.
Suzuki et al., "Application of a high-tension annealing method to nylon 66 fibres," Polymer 39(6-7):1351-1355, Jan. 1, 1998.
Timoshenko, "Analysis of Bi-Metal Thermostats," Journal of the Optical Society of America 11(3):233-255, Sep. 1, 1925.
Tsujimoto et al., "Changes in Fine Structure of Nylon 6 Gut Yams in Twisting, Annealing and Untwisting Processes," Journal of the Textile Machinery Society of Japan 25(4):87-92, Dec. 1979; first disclosed in Journal of the Textile Machinery Society of Japan 31(12):T171-5, Dec. 25, 1978.
Stoffberg et al., "The Effect of Fabric Structural Parameters and Fiber Type on the Comfort-related Properties of Commercial Apparel Fabrics," Journal of Natural Fibers, Oct. 13, 2015, 15 pages.
Tugrul, "Air Permeability of Woven Fabrics," JTAM, 2006, 10 pages.
Van Der Heijden et al., "Helical and Localised Buckling in Twisted Rods: A Unified Analysis of the Symmetric Case," Nonlinear Dynamics 21(1):71-99, Jan. 1, 2000.
Kang et al., "A top-down multi-scale modeling for actuation response of polymeric artificial muscles," Journal of the Mechanics and Physics of Solids 92:237-259, online publication Apr. 6, 2016, print publication Jul. 2016.
Zhang et al., "Multiscale deformations lead to high toughness and circularly polarized emission in helical nacre-like fibres," Nature Communications 7:10701, Feb. 24, 2016, 28 pages.
Korean IPO Decision of Patent Grant dated Mar. 14, 2022, Application No. 10-2017-7036923, 2 pages.
China IPO Decision of Patent Grant dated Apr. 26, 2022, Application No. 201880024236.5, 2 pages.
European Patent Office Office Action for Patent Application No. 16 797 388.2 dated Apr. 26, 2022, 6 pages.

* cited by examiner

COILED ACTUATOR SYSTEM AND METHOD

CROSS-REFERENCE TO RELATED APPLICATIONS

This application is a continuation of U.S. application Ser. No. 15/949,881, filed Apr. 10, 2018, which is a non-provisional of and claims the benefit of U.S. provisional application 62/483,839, filed Apr. 10, 2017 entitled "COILED ACTUATOR SYSTEM AND METHOD," which applications are hereby incorporated herein by reference in their entirety and for all purposes.

This application is also related to PCT Application PCT/US2018/026941, filed Apr. 10, 2018 entitled "COILED ACTUATOR SYSTEM AND METHOD" and is also related to U.S. application Ser. No. 15/160,439 filed May 20, 2016 entitled "SYSTEM AND METHOD FOR THERMALLY ADAPTIVE MATERIALS," which applications are hereby incorporated herein by reference in their entirety and for all purposes.

GOVERNMENT RIGHTS

This invention was made with government support under DE-AR0000536 awarded by the U.S. Department of Energy. The government has certain rights in the invention.

Figure 1:
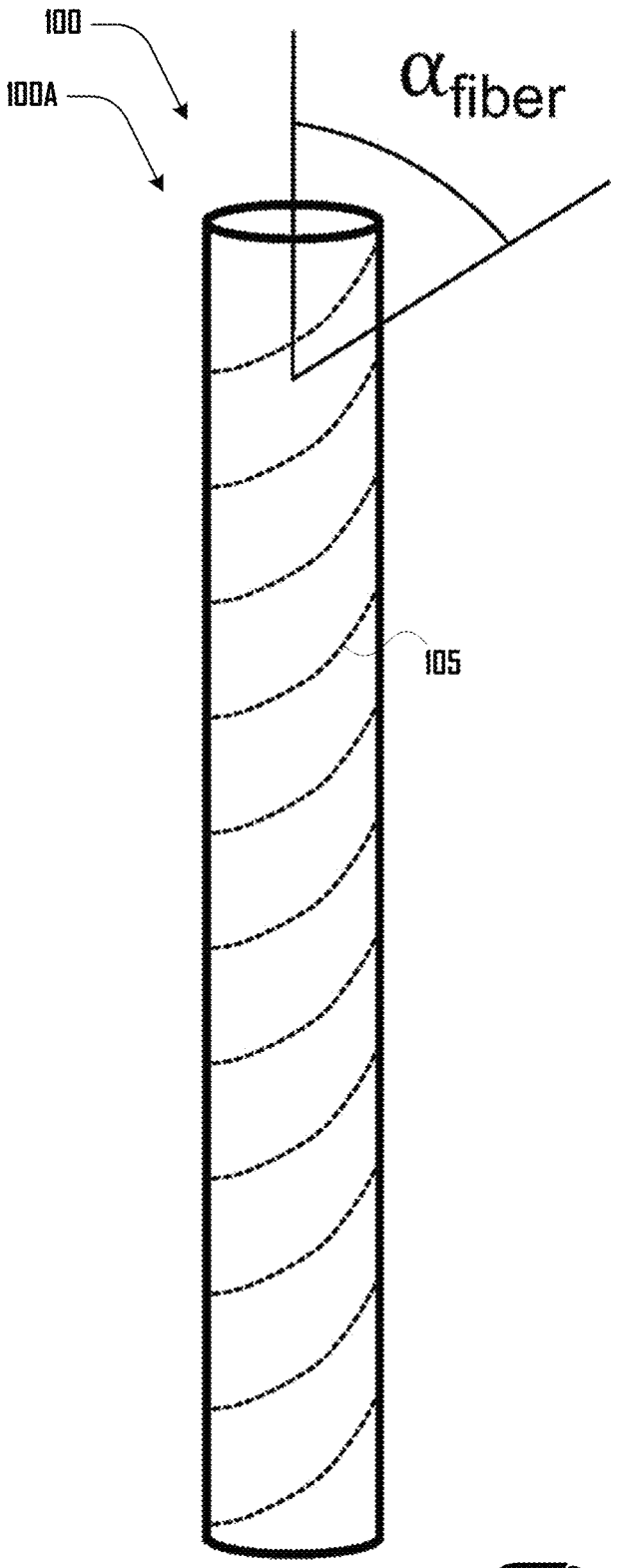
FIG. 1 is an illustration of a twisted fiber, filament, or yarn, showing the fiber bias angle ($\alpha_{fiber}$).

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

In various embodiments, coiled actuators ("artificial muscles") can be produced through a twist insertion process. For example, a fiber can be twisted to the point of coiling. In another example, a fiber can be twisted nearly to the point of coiling and then wrapped around a mandrel or fiber or yarn core. Although various examples discussed herein refer to a fiber, it should be clear that various embodiments can comprise any suitable elongated element, including a fiber, filament, ribbon, yarn, line, or the like. Additionally, as used herein, a 'fiber' can encompass any such elongated elements, including a yarn comprising one or more fibers or other elements, a fiber comprising a single elongated element, or the like. Accordingly, the term 'fiber' should be construed to broadly encompass any such elongated element or elements unless the context dictates otherwise.

In some embodiments, the coiled actuator fibers discussed herein can be used for actuating textiles. For example, such textiles can be used in the production of clothing that reacts to various types of environmental conditions, including temperature, moisture, humidity, and the like. In some implementations there can be minimal loading of the textile and/or the textile may need to operate around body temperature, and various embodiments can be configured for desirable operation under such operating conditions. Further embodiments can be configured for various other suitable purposes or applications and therefore the examples that relate to configuration for use by human or animal users should not be construed to be limiting on the numerous applications of the actuators disclosed herein.

Various embodiments can have numerous advantages for some uses or implementations. For example, some embodiments of actuators can include larger thermal response values for actuators produced using manufacturing-friendly techniques, where the actuators have a controlled coil contact temperature and range of thermal response.

Coiled thermal fiber or yarn actuators, in accordance with various embodiments, can be made via coiling from twisting to the point of writhe or snarling (self-coiled or coiled-by-twisting), via coiling around a mandrel or other suitable material that serves as a core about which the fiber or fibers can be wound (coiled-by-wrapping), or other suitable method. In various examples, such a core can be removable in part or in whole, including removal via dissolving as discussed in more detail herein.

In some examples, conventional yarn production machinery such as spinning or twisting machines are unable to reliably produce desirable controlled-geometry fiber or yarn actuators that are coiled-by-twisting. The production of such yarns can be highly sensitive to variables such as ambient temperature and humidity, input filament crystallinity and orientation, friction, defects in the input filament, variations in spindle speed, feed rate, or take-up speed, input filament diameter, yarn tension, and the like.

However, as discussed in more detail herein, in various embodiments, a careful balance between yarn tension, yarn feed rate, inserted twists/m, package take up rate, flyer (or ring and traveler) rotational rate during yarn production, and the like, can yield highly twisted or coiled actuators with controllable geometry. One or more of these parameters may need to be changed or adjusted during production to account for fluctuations in the aforementioned variables; however, some conventional production machines do not allow for changes in such parameters during production. Furthermore, parameters for one position or spindle may need to be changed differently than the parameters in another position or spindle, a task that may be impossible for some systems if several positions are driven with a common drive. Accordingly, novel machines that provide for such functionalities are disclosed herein.

Example methods to insert twist into a filament yarn or fiber (either a monofilament or a multifilament) can include ring twisting, friction spinning, two-for-one twisting, and the like. Ring spinning can be a process that utilizes the motion of a guide, called a traveler, which freely circulates around a ring to insert twist and simultaneously wind the formed yarn onto a bobbin. In a production environment, spindles can be driven using a common belt drive system. The amount of twist inserted into a fiber can be determined by the speed of the yarn coming off of the feed rolls and the rotational rate of the spindle. The traveler (also known as a follower) can have a rotational speed that can lag that of the spindle due to friction and tension. The difference in rotational speeds between the traveler and the spindle can result in yarn take-up around a bobbin. Flyer spinning and roving can follow a similar principle to ring spinning, where a flyer rotates around a rotating spindle at a different speed, resulting in twist insertion and yarn take-up. In two-for-one twisting, twist levels can be controlled by setting the yarn feed rate and the spindle rotational speed or the take-up reel rotational speed and the spindle rotational speed. Motors controlling the yarn feed, spindles, and/or take-up reels for different positions on a production machine can be driven with a common belt drive system for economy or other purpose.

Winding a highly twisted fiber around a mandrel or other core material such as another fiber or yarn can, in some embodiments, provide a route to larger diameter, more open coils with larger coil spring index values, providing a method of addressing the thermal response. However, in some examples, winding about a mandrel may not be well-suited for mass manufacture because of the challenges of removing the mandrel from the coiled fiber or yarn actuator that is produced. Mandrel winding can be more appropriate for mass manufacture in some examples if the process includes a short mandrel, possibly tapered at one end, which can be held on one side where fiber, fibers, or yarn, are fed in for wrapping around the mandrel. As the fiber coils about the mandrel and advances, the fiber can fall off the end of the mandrel and can be wound onto a cone or drum. For fiber or yarn actuators, in some embodiments the twisted fiber, fibers, or yarns used in the wrapping or winding process have been set (by heating, steam, or chemical or mechanical treatment) prior to wrapping or winding, and in some embodiments can be set after the winding or wrapping process. In some examples, as described in more detail herein, a sacrificial material can be used as a core in a process where a fiber or yarn is coiled through winding or wrapping around the sacrificial material, and the sacrificial material can be later removed through physical means, dissolution, melting, washing, chemical methods, or the like.

One approach that can address coil geometry (e.g., thermal response) and/or coil spacing (e.g., active temperature range) can include the use of sacrificial materials. In one such embodiment, a coextruded multicomponent fiber such as a core-sheath structure, or the like, can be twisted and coiled (e.g., from insertion of twist or through winding around a mandrel or other core material, and the coiled actuators can be optionally untwisted) to form a thermal actuator. By dissolving or chemically reacting the sheath so that the sheath is removed, the spring index of the coil can be increased, simultaneously increasing the coil spacing of some examples. In some examples, the removal of the sheath material (or materials) can be done either prior to heat setting or after heat setting.

Some twisting and spinning techniques and machines can be limited in their rotational rate by the need to rotate a yarn or fiber package. False twist techniques can overcome these practical rotational speed limits by spinning a much smaller mass; however, in various examples, such methods may not insert true twist and may not allow for the production of highly twisted and coiled fibers and yarns having desirable properties. The high rotational rates of some false twist techniques can be utilized in a twisting or coiling process, in some examples, if the imparted twist is let out on the side on which the fiber or yarn is fed into the twister, thereby the other side of the twisting unit can be imparting real twist and may not simply be removing the twist imparted on the opposite side of the twisting unit. Twist can be let out on the feed-in side of the machinery through two similar approaches. One approach is to feed individual staple fibers into the unit and form a yarn at the site of the twisting unit, similar to open-end spinning. In various examples, the machinery does not need to spin a large mass and there may be no false-twisting because the yarn can be formed at the site of rotation. A second approach is to twist the extruded fiber as a part of an in-line process, where the twist is let out due to molecular slip near the site of extrusion of the melt, gel, or solution.

FIG. 1 shows an example 100A of a twisted fiber 100 showing the fiber bias angle ($\alpha_{fiber}$). A level of twist in the fiber 100, in this example, is represented by dashed lines 105 twisting across the fiber 100. In various embodiments, a twist level can be directly observed and determined from a fiber 100 through examination under a microscope. As shown in FIG. 1, a fiber bias angle $\alpha_{fiber}$ can be determined by measuring an angle between the observed twist at the fiber surface and the axial direction of the fiber 100. For an untwisted fiber the fiber bias angle will be 0° in various examples.

Fibers, filaments, and yarns can be twisted during processing and in end-use applications. The fiber and yarn actuators described herein can have what is described as a "high level of twist" (or being "highly twisted"), which in some examples can include an amount of twist sufficient to bring about a fiber bias angle $\alpha_{fiber}$ of 20° or greater in some embodiments, and in further embodiments a fiber bias angle $\alpha_{fiber}$ of between 25° to 50°. In some examples "highly twisted" or having a "high level of twist" can include an amount of twist that generates a fiber bias angle $\alpha_{fiber}$ of greater than or equal to 10°, 15°, 20°, 25°, 30°, 35°, 40°, 45°, 50°, or 55° and the like. As twist is inserted into a fiber or yarn and the fiber bias angle increases the fiber or yarn has a tendency to snarl. The onset of this snarling depends on a number of variables, including environmental conditions, the material, the material's processing history, and the tension on the fiber or yarn. Often fiber or yarn snarls when the fiber bias angle $\alpha_{fiber}$ is above 40°, in some cases around 45°. In some embodiments it is advantageous to produce a highly twisted fiber or yarn with a fiber bias angle $\alpha_{fiber}$ between 300 and 40°, decreasing the likelihood of initiating snarl while still producing a highly twisted filament that can be used to produce a coiled fiber actuator by wrapping around a core material.

Conditions for producing such highly twisted fibers 100 can vary with environmental conditions, material identity, material processing history, and fiber diameter, with larger diameters in some examples requiring less twist to bring about a given fiber bias angle $\alpha_{fiber}$. In a yarn, the effective fiber bias angle $\alpha_{fiber}$ can be understood to be the angle of a filament at the surface of the twisted or highly twisted yarn.

For fiber materials like nylon, polyester, and the like, coefficient of thermal expansion (CTE) values can be around 0.05 mm/m/° C., in some examples, and in further examples, do not exceed about 0.1 mm/m/° C. In drawn fibers or sheets, the ordering of polymeric chains can give rise to anisotropic properties and CTE values can drop by a factor of ten or more in the draw direction in some examples, or becoming negative in further examples. However, a thermomechanical response of a fiber 100 can be effectively amplified in some examples through the use of a coil or spring structure. Commodity fibers and yarns can be coiled or "cylindrically snarled" through the insertion of a high level of twist, producing coiled fiber thermal actuators in accordance with some embodiments that can be described as "artificial muscles," essentially fibers or yarns that have been coiled like a spring so that they have giant or exaggerated thermal expansion properties.

Figure 2:
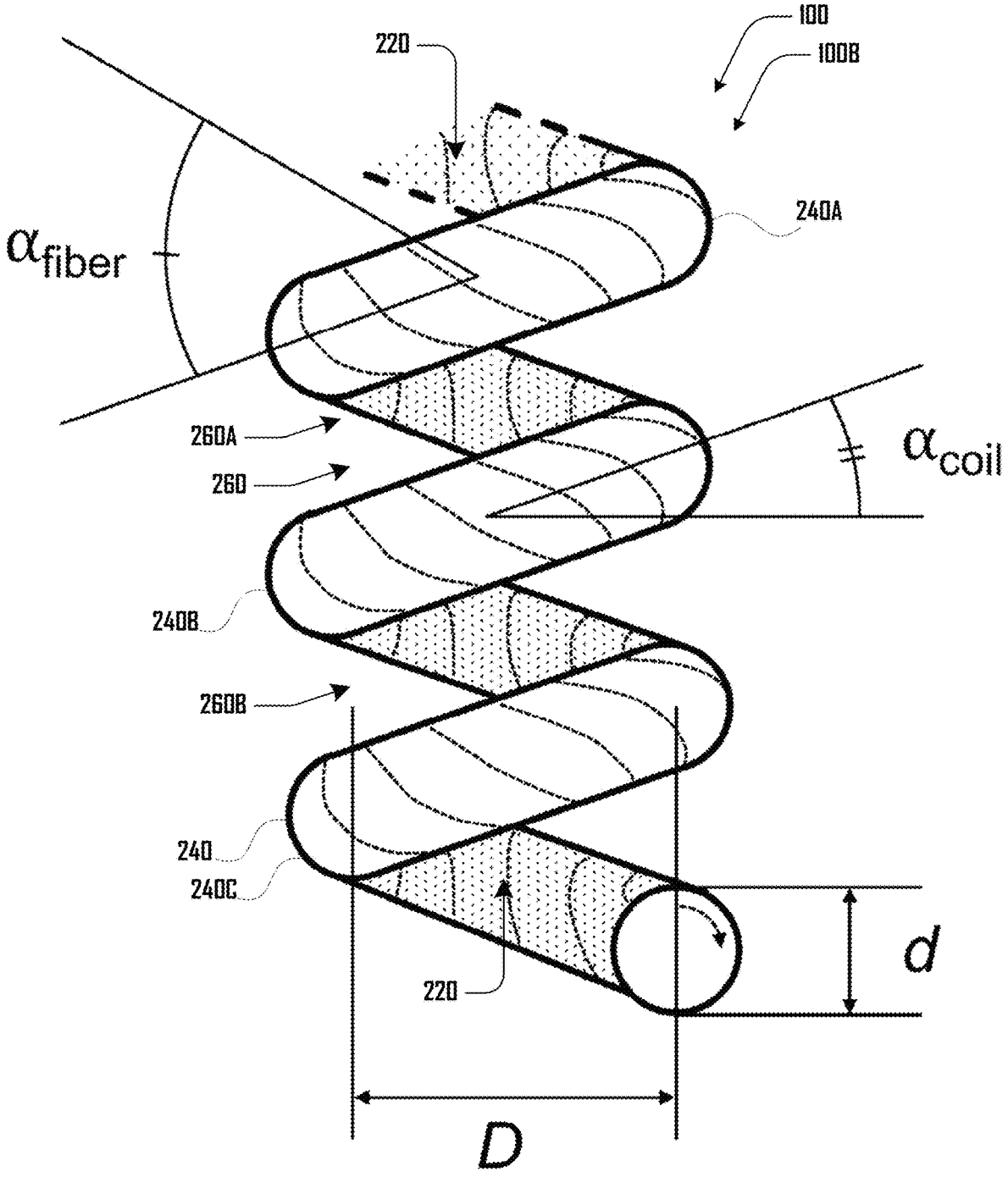
FIG. 2 is an illustration of a twisted and coiled fiber or yarn, showing the fiber bias angle ($\alpha_{fiber}$), coil bias angle ($\alpha_{coil}$), coil diameter (D), and fiber diameter (d).

FIG. 2 is an illustration of an example 100 of a twisted and coiled fiber 100, showing a fiber bias angle ($\alpha_{fiber}$), coil bias angle ($\alpha_{coil}$), coil diameter (D), and fiber diameter (d). The fiber 100 of FIG. 1 is shown in a coiled configuration that defines a cavity 220 that extends within the coiled fiber 100. In this example, adjacent coil portions 240 of the coiled fiber 100 are spaced apart to define a space 260 between the adjacent coil portions 240. For example, a first and second coil portion 240A, 240B of the coiled fiber 100 define a first space 260A and the second and third coil portions 240B, 240C of the coiled fiber 100 defined a second space 260B. In this example, the first and second spaces 260A, 260B define a contiguous space 260 that extends within the coiled fiber 100. In further examples as described in more detail herein, coil portions 240 of the coiled fiber 100 can engage such that some or all of the space 260 between portions 240 of the coiled fiber 100 becomes absent (e.g., FIG. 3*b*).

A twisted fiber 100 can have a fiber bias angle $\alpha_{fiber}$ as shown in FIGS. 1 and 2. In a fiber 100 twisted to the point of coiling, the fiber bias angle $\alpha_{fiber}$ can be determined by the material and the process conditions used to form the coil. However, in some embodiments, this may not lead to the optimal or desired fiber bias angle $\alpha_{fiber}$ for a particular targeted temperature response. Coil formation through winding or wrapping around a mandrel or other core can enable the formation of coils produced from one or more fibers 100 that have been highly twisted to produce the desired fiber bias angle $\alpha_{fiber}$. In some embodiments, a desired fiber bias angle $\alpha_{fiber}$ can be between 300 and 50°, and more preferably between 35 and 450 in some examples.

Coil diameter (D), and fiber diameter (d) can be used to calculate a coil spring index (C). For example, spring index (C) can be defined in spring mechanics as C=D/d, where d is the fiber diameter and D is the nominal coil diameter as measured by the fiber centerline as illustrated in FIG. 2. A coil or spring with a large spring index (C) can be more open, with a larger diameter, while a coil with a small spring index (C) can more closely resemble a tight coil with a small diameter. Properties such as the effective Coefficient of Thermal Expansion (CTE) and stiffness (e.g., modulus) of a coiled actuator can be dependent on the geometry of the coil (e.g., the spring index C and the coil bias angle $\alpha_{coil}$, with the structure of the fiber also contributing, including the fiber bias angle $\alpha_{fiber}$). In some embodiments, by varying the spring index (C), actuation stroke and/or stress can be tunable to desired parameters.

In various embodiments, the thermal response of a coiled fiber 100 can be controlled through the geometry of the coil 100. In some applications it is advantageous to maximize the thermal response of the coiled fiber 100, which in some examples can require a large coil diameter (D) (e.g., relative to the fiber diameter (d)). Coiled fibers 100 formed without winding around a mandrel, yarn, fiber, or other core, can be limited to small coil diameters (D) and small values of the coil spring index (C) in some examples. To move beyond this limitation with fiber and yarn actuators produced by self-coiling, to achieve large coil diameters (D) with a coil spring index (C) substantially above about 1.7, above 2.0, or above 2.5, and effective coefficients of thermal expansion (CTE) of −2 mm/m/K or greater in magnitude, the as-formed coil of some embodiments can be untwisted (that is, twisted in the reverse direction, opposite to the direction of the inserted twist that brought about the coiling) to remove excess residual twist and residual compressive mechanical stress. This untwist can change the geometry of the coils, increasing their diameter, but in various embodiments does not need to be carried out to the point of removing coils to achieve the desired results. In some embodiments, the largest coil diameters (D) are realized not by carrying out the controlled untwisting under the tensile loads that were appropriate for the coiling process, but rather under small loads (e.g., ≤50% of the load used during the coiling step)

or even near-zero loads (e.g., ≤10% of the load used during the coiling step, a negligible tensile load, or the like). Untwisting, in some embodiments, can be used to influence the coil spring index (C) and/or geometry of coils produced through a winding process.

The coil bias angle ($\alpha_{coil}$) can be determined by measuring an angle between the axial direction of the twisted fiber 100 and an imaginary line orthogonal to the direction that the coiled fiber 100 runs along. As a coiled fiber 100 is stretched like a spring a coil bias angle ($\alpha_{coil}$) can increase, and for a given coiled fiber 100, the coil bias angle ($\alpha_{coil}$) can reach its smallest value when the coiled fiber 100 is fully compressed to the point of coil portions 240 of the fiber 100 coming into contact with each other.

In addition to the coil spring index (C), which can reflect the overall coil diameter (D) with respect to the fiber diameter (d), of the fiber 100 from which the coil is made, the coil bias angle $\alpha_{coil}$ can be a measure of the structure of the coil that relates to the properties of the coil. When coils form under the influence of excessive or high twist (coiled-by-twisting) portions 240 of the coiled fiber 100 can come into physical contact with each, with each coil portion 240 touching its neighbor coil portion 240. An optimal stacking of such coils can lead to a minimization of the coil bias angle $\alpha_{coil}$ and can generate a maximized response to a change in temperature or other environmental parameter. If the coiled fiber 100 is physically extended and the coils pull apart to generate space 260 between coil portions 240, the coil bias angle $\alpha_{coil}$ can increase and the temperature response can be reduced in some examples.

While various coiled fiber actuators that are coiled through the insertion of twist (coiled-by-twisting) can form coils with the minimum coil bias angle $\alpha_{coil}$ for a coil of that size, when coils are formed by winding around a core material (coiled-by-wrapping), in some examples as described herein, there can be some additional control over the coil bias angle $\alpha_{coil}$ that is possible, as the wrapped fiber or yarn can be spaced in such a way that the coil bias angle $\alpha_{coil}$ is at its minimum value for the coil spring index (C) (adjacent coils are in contact with each other) or so that the coil bias angle $\alpha_{coil}$ is larger (with some amount of spacing 260 between adjacent coil portions 240). In some applications, it can be advantageous to maximize the thermal response of the actuator, requiring smaller coil bias angle $\alpha_{coil}$. Control of the coil bias angle $\alpha_{coil}$ can also be related to control of the coil-to-coil contact temperature and the actuator's environmental response range.

As with FIG. 1, a level of twist in the fiber 100 is represented by dashed lines 105 twisting across the fiber 100. Toward the bottom of the illustration of FIG. 2, the twisted fiber 100 is shown in cross section and the dashed arrow represents a direction of the twist in the twisted fiber 100. As illustrated in the example of FIG. 2, the twist is in the Z-direction, as is the coil, and therefore the coiled fiber 100 can be defined as being homochiral. Further examples of coiled fibers 100 can have any suitable chirality. Near the top of the illustration, the fiber or coil is shown through dashed lines as an indication that the fiber 100 coil can continue with arbitrary length. Accordingly, coiled fibers 100 as discussed herein can have any suitable length in various embodiments. Shaded sections of the twisted fiber represent the portion of the coiled fiber 100 receding into the illustration page.

Figure 3B:
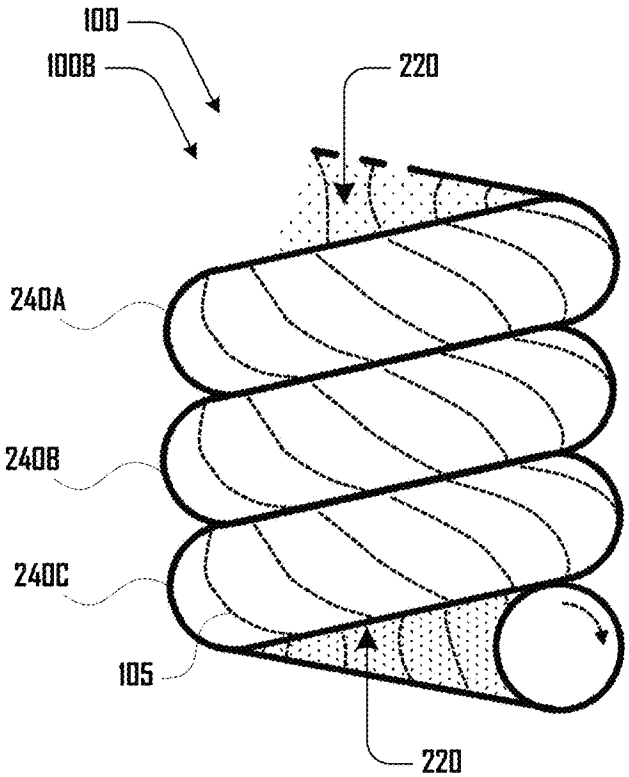
FIGS. 3*a* and 3*b* are illustrations of two example coiled fibers or yarns with different coil bias angles.
Figure 3A:
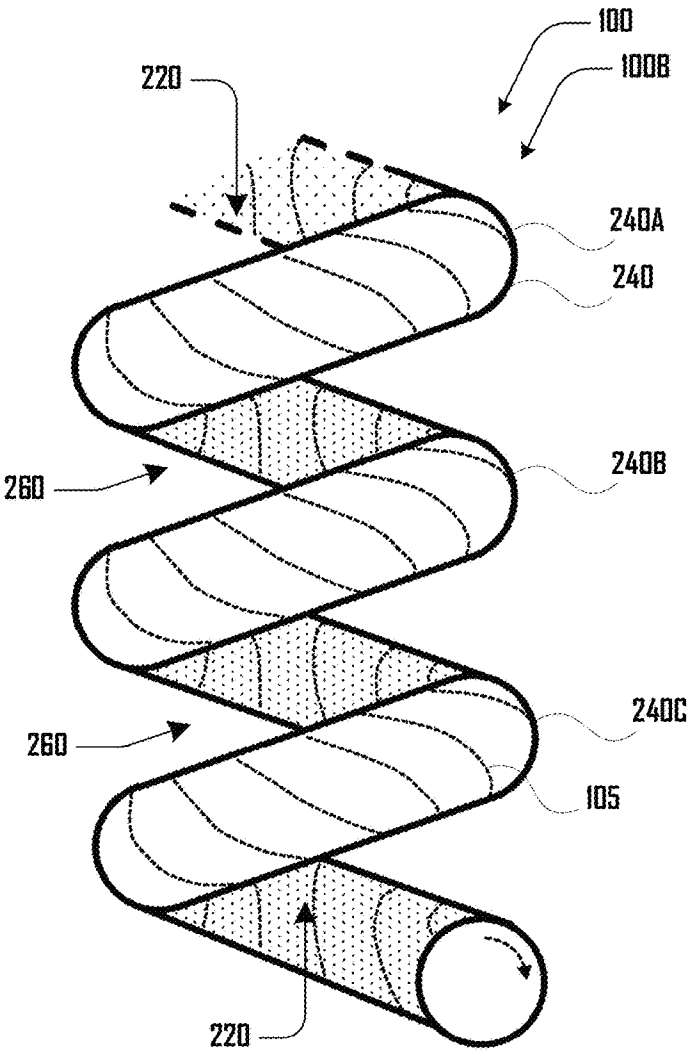

FIGS. 3*a* and 3*b* illustrate the example coiled fiber 100 of FIG. 2 in two different configurations having different coil bias angles. The coiled fiber 100 of FIG. 3*a* has similar spring index (C) as that of the coiled fiber 100 of FIG. 3*b*. In various examples, the coiled fiber 100B of FIG. 3*b* can be stretched to generate a configuration similar to the coiled fiber configuration of FIG. 3*a*, through a mechanical stress, through a change in temperature that generates an expansion, or the like. Similarly, the coiled fiber 100B of FIG. 3*a* can be compressed to generate a configuration similar to the coiled fiber configuration of FIG. 3*a*, through a mechanical stress, through a change in temperature that generates a compression, or the like. The example coiled fibers 100 of FIGS. 3*a* and 3*b* are homochiral and a decrease in temperature can lead to a linear expansion of the coiled fiber 100 in some embodiments.

Figure 4B:
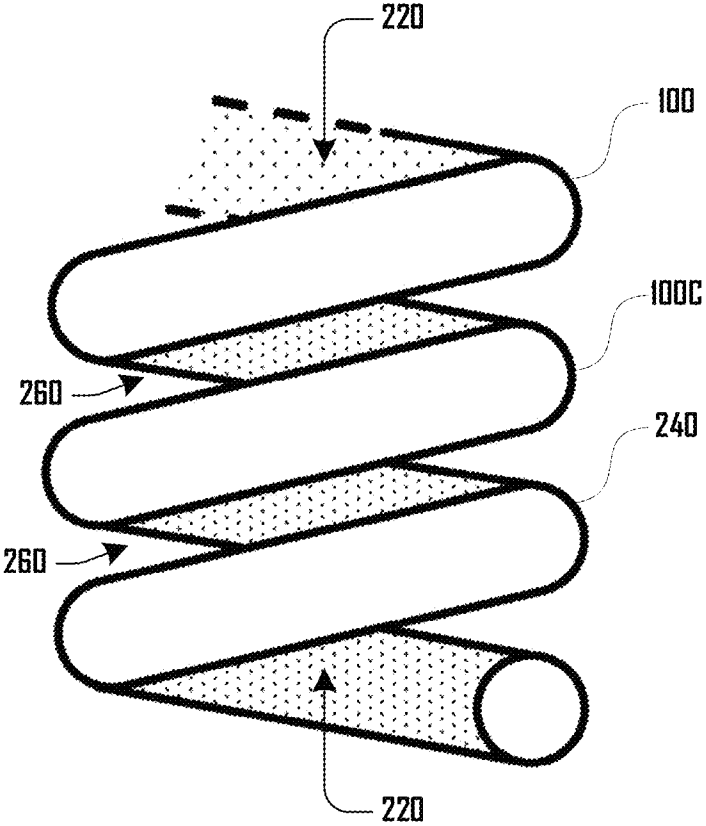
FIGS. 4*a* and 4*b* are illustrations of another example of a twisted fiber or yarn generated by removing a sacrificial layer to increase the distance or spacing between the coils.
Figure 4A:
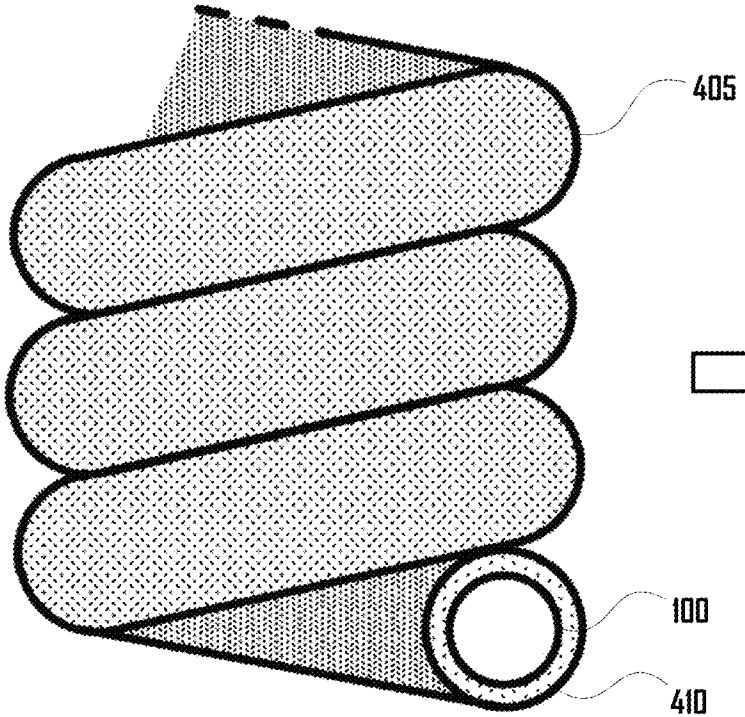

FIGS. 4*a* and 4*b* show the use of a sacrificial material 410 in the control of coil geometry of a coiled fiber 100. For example, FIG. 4*a* illustrates a core coiled fiber 100 having a shell 410 (or an island in a sea), where the shell 410 can be a removable material. For example, in some embodiments, the shell 410 can be removable (e.g., via washing, chemical dissolving, or the like), and a resulting coiled fiber 100, as shown in the example of FIG. 4*b*, can have additional spacing between coils of the fiber 100 and/or a different coil index value. For example, as shown in FIG. 4*b*, space 260 can be generated between respective portions 240 of the coiled fiber 100. Although the coiled fiber 100 of FIGS. 4*a* and 4*b* does not depict a twist in the fiber 100, in further embodiments, the coiled fiber 100 can comprise a twist of any suitable amount.

Figure 5B:
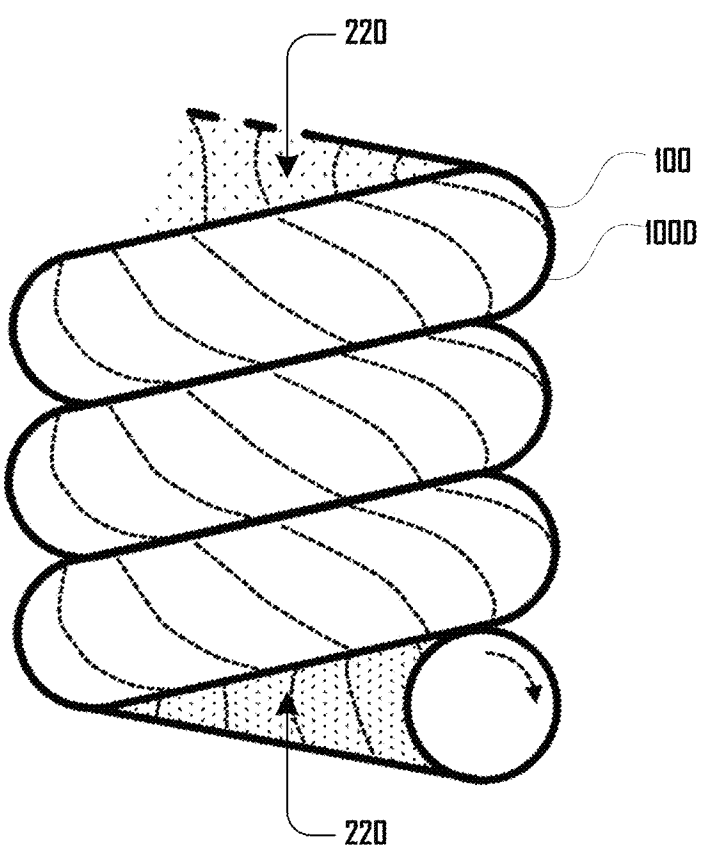
FIGS. 5*a* and 5*b* illustrates a further example of a coiled fiber or yarn produced by wrapping a twisted fiber or yarn around a mandrel or core material, such as another fiber or yarn, and the freed coiled fiber or yarn being produced after removing the mandrel or central core material.
Figure 5A:
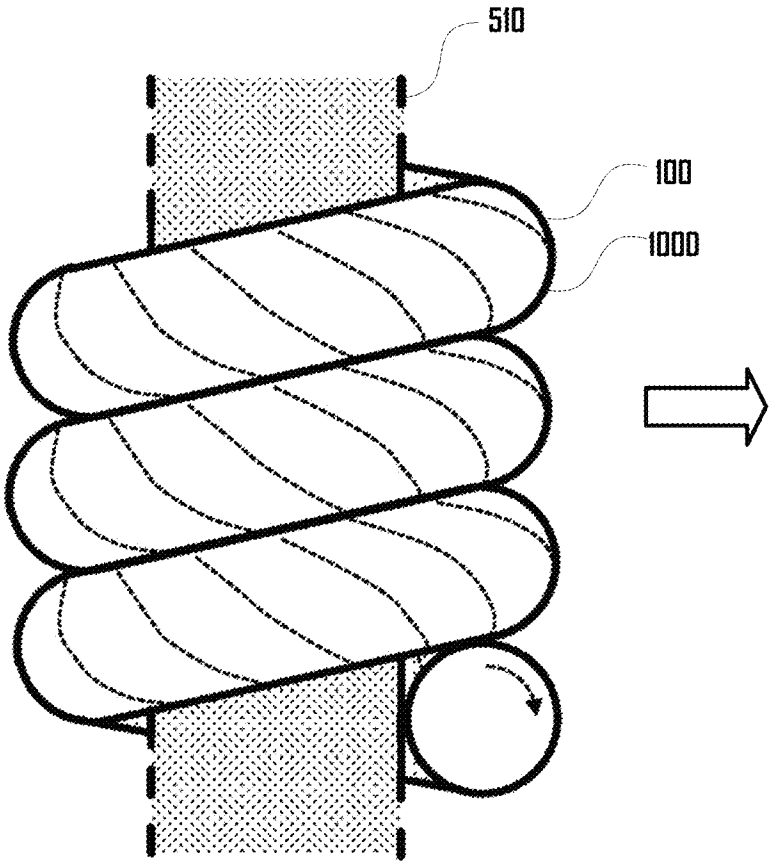

FIGS. 5*a* and 5*b* show the use of a sacrificial core 510 in the control of coil geometry, showing a twisted fiber 100 wrapped around a core 510 that can define the inner diameter of the coiled fiber 100. The dashed lines of the core 510 indicate that the core 510 can have any suitable length. The core 510 can be disposed within the cavity 220 of the coiled fiber 100 and can comprise element including a mandrel, filament, yarn, or the like. In various embodiments, the core 510 as shown in FIG. 5*a* can be removed (e.g., physically, chemically, or other suitable way) to yield a free coiled fiber 100 as shown in FIG. 5*b*. In one embodiment, the central core 510 can comprise a filament or yarn that include a soluble polymer such as polyvinyl alcohol, ethylene vinyl alcohol, or the like, that can be dissolved in water or other solvent, including at any suitable temperature such as room temperature, 40° C., 60° C., 80° C., or higher or lower temperature.

For production methods that wrap one or more twisted fiber 100 around a sacrificial core 510, the core 510 need not be completely removed, and in some instances it can be desirable to have a portion of the core 510 remain. Having a portion of the core 510 remaining in the cavity 220 of the coiled actuator fiber 100 can be advantageous in a number of other ways, including cases where the remaining material is conductive (e.g., a metal, composite, organic material, or the like) and can allow heating of the material, and cases where the material is extensible (e.g., due to its chemical nature, mechanical structure, or the like), allowing for easy linear extension but adding strength to the material with respect to bending or buckling.

By way of illustration, a water-soluble fiber could be used as the core 510 in a covered yarn, where the covering fiber or fibers were twisted prior to or during the winding that constitutes the wrapping of the core 510, and after setting the wound fibers 100, the core 510 can be removed through a washing step. A number of materials are appropriate for use as a central sacrificial core 510, such as water soluble polymeric filaments or yarns, organic-soluble polymeric filaments or yarns, or filaments or yarns that are readily dissolved or degraded in the presence of acid or base, oxidizing or reducing agents, or other chemical reagent.

As one non-limiting example, an "islands-in-sea" yarn can be used as a sacrificial core 510, and upon washing out the "sea" component of the yarn a fine-fiber yarn can remain inside the cavity 220 of the coil actuator. These fibers could be useful in moisture management or limiting the range of motion of the fiber actuator. In the case of a homochiral fiber actuator, an effective minimum length can be realized at a coil contact temperature (i.e., where some or all portions 240 of coiled fiber 100 come in contact such that space 260 is partially or fully absent; a homochiral fiber actuator will have physical space between its coils at temperatures below the coil contact temperature), but as temperatures drop and the coil expands, the extent of the motion of the coiled fiber 100 can be limited by the presence of one or more fibers running through the cavity 220 of the coiled fiber 100. An "islands-in-sea" yarn can be made from a multi-component extruded fiber, where at least one component can be soluble or otherwise removable, enabling the formation of fine features, including "islands," of a non-sacrificial material in a "sea" of the sacrificial material. At some point in the processing, the sacrificial material can be removed, leaving behind the "islands," which can be fine-featured fibers that would be difficult to handle at high speed on some machinery if they had not been protected by the sacrificial "sea" material.

Figure 6B:
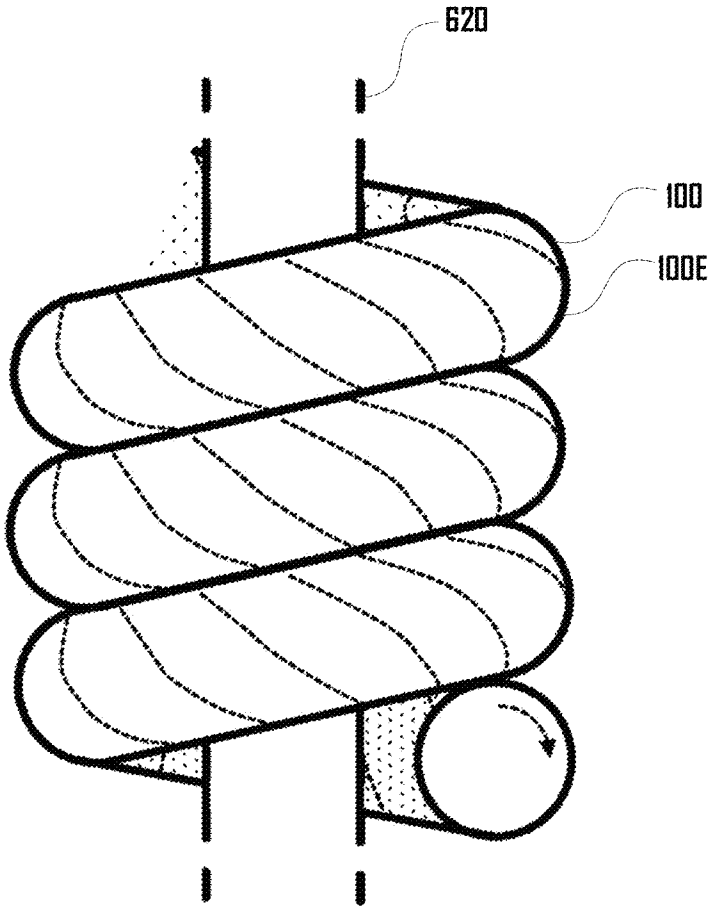
FIGS. 6*a* and 6*b* illustrate a still further example of a coiled fiber or yarn produced by wrapping a twisted fiber or yarn around a core material that includes a central core covered in a removable material, and illustrate the example coiled fiber or yarn produced after dissolving or reacting the removable material, leaving behind a central material at the center of the coiled fiber or yarn.
Figure 6A:
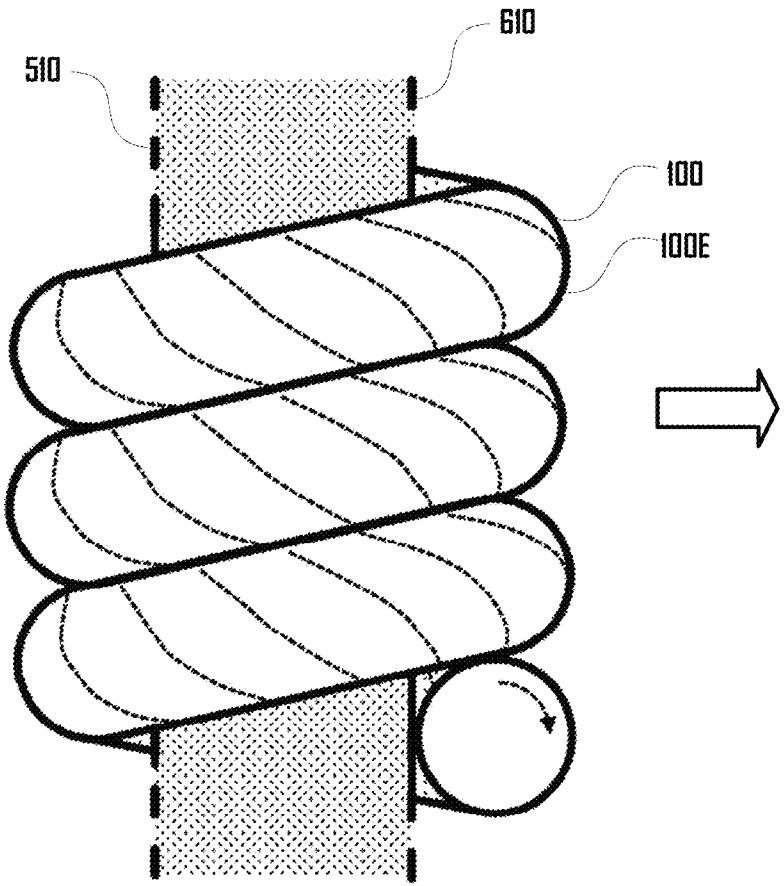

For example, FIGS. 6*a* and 6*b* illustrate another example 100E of a coiled fiber 100 that can be produced by wrapping a twisted fiber 100 around a core 510 that comprises a removable shell material 610 and an inner material 620. In the example of FIG. 6*a*, the core 510 can comprise an outer layer or shell material 510 that can be soluble or otherwise removable, and after wrapping the twisted fiber 100 around the core 510 the removable shell material 610 can be dissolved or otherwise taken away, freeing the coiled fiber 100 to move while leaving a smaller central core inner material 620 as shown in FIG. 6*b*. While this remaining core material is illustrated as a single material in a single strand, it can comprise multiple materials and/or multiple strands in some embodiments.

Figure 7B:
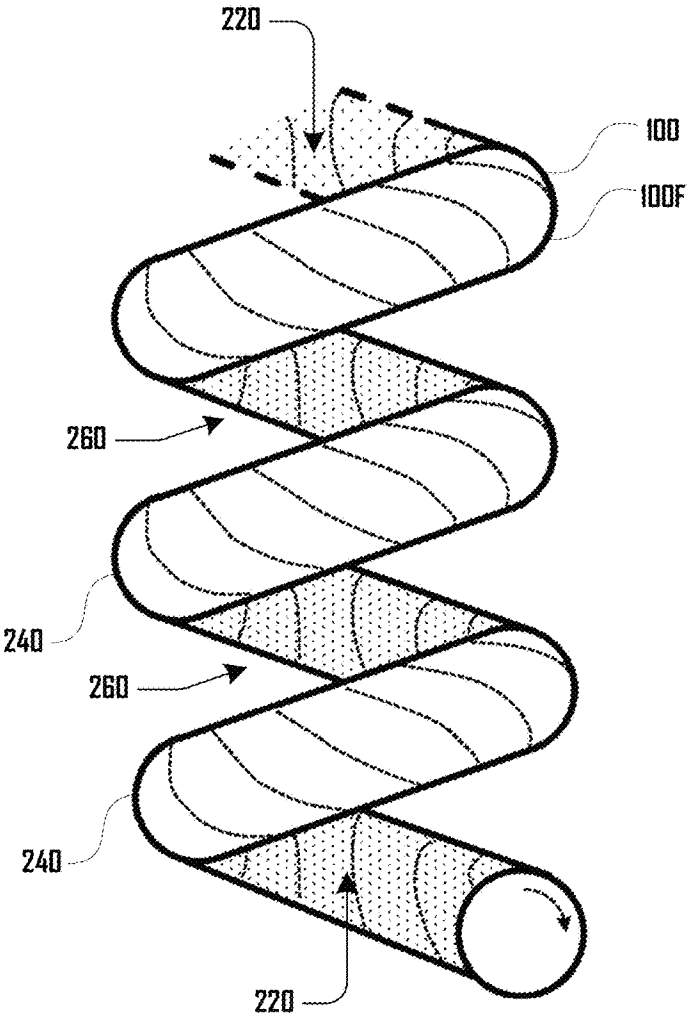
FIGS. 7*a* and 7*b* illustrate an example of a twisted fiber or yarn coiled around a mandrel or central core in such a way that the fiber or yarn is not in contact with a nearest neighbor, and further illustrate the coiled fiber or yarn produced after removing the mandrel or central core.
Figure 7A:
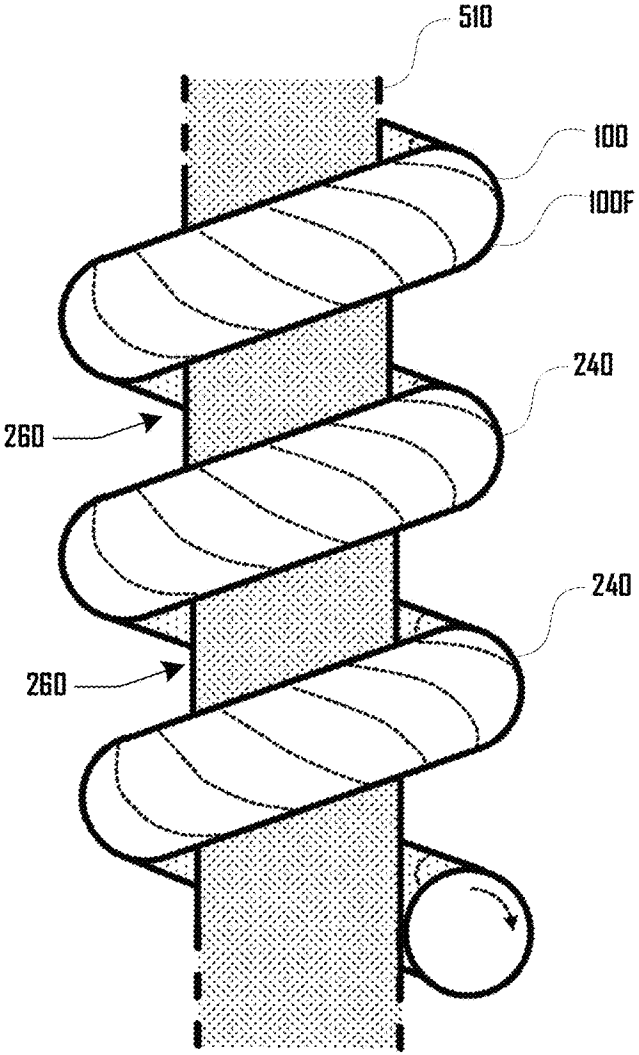

Through the control of the number of twists or wraps per meter about a core 510 the coil spacing can be controlled for an actuator comprising one or more coiled fiber 100 produced by winding, including coiled fibers 100 with or without spaces 260 between portions 240 of the coiled fiber 100. For example, FIG. 7*a* illustrates another example 100F of a twisted fiber 100 coiled around core 510 (e.g., a mandrel or central core having one or more material as discussed herein) in such a way that each fiber yarn coil portion 240 is not in contact with the nearest neighboring coil portion 240 such that space 260 is generated within the coiled fiber 100. Upon removal of the core 510 as shown in FIG. 7*b* (e.g., via dissolution, physical removal, or the like) the coiled fiber 100 can become free for unimpeded motion in response to changing environmental conditions (e.g., temperature, humidity, and the like as discussed herein).

Figure 8B:
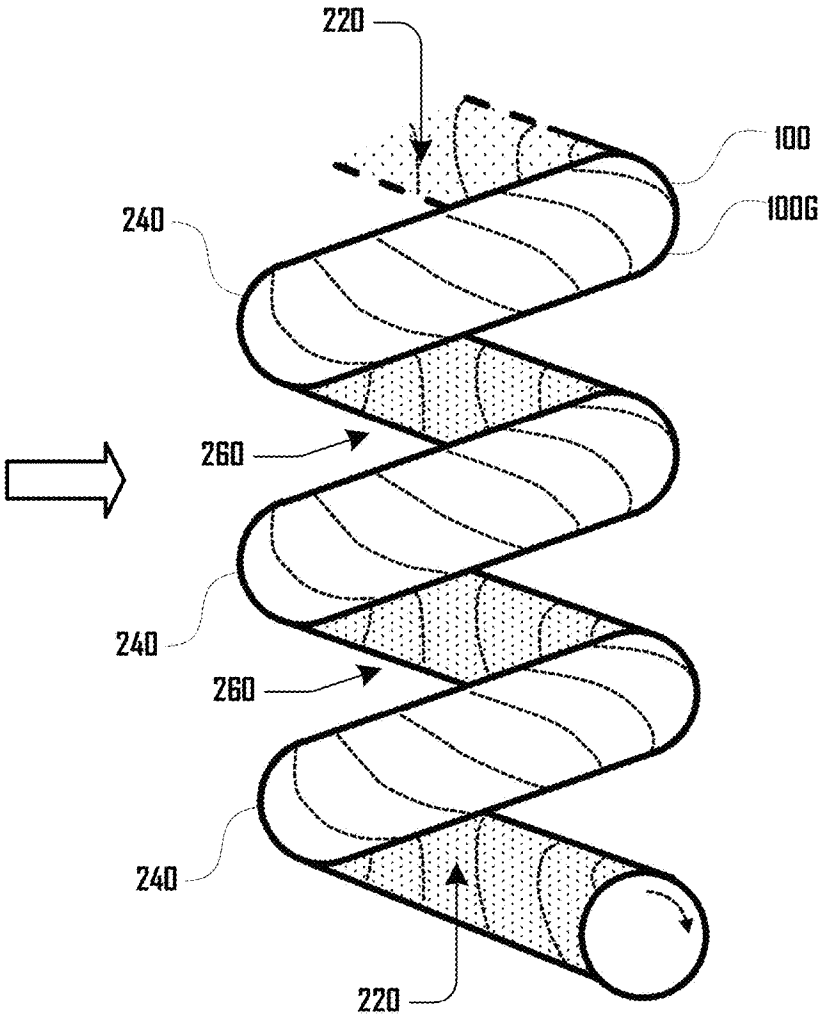
FIGS. 8*a* and 8*b* illustrate another example of a twisted fiber or yarn that is coiled around a mandrel or central core alongside a second fiber or yarn that serves as a spacer for the twisted fiber or yarn and illustrate the coiled fiber or yarn that is produced by removing the mandrel or central core and the spacer fiber or yarn.
Figure 8A:
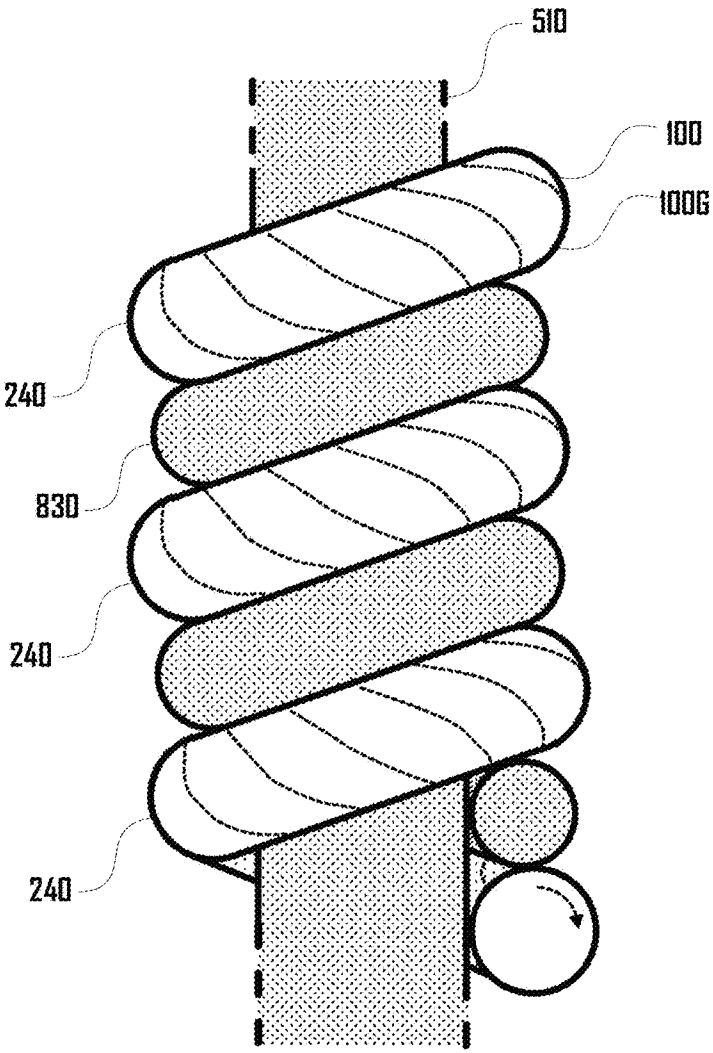

Spacing between coil portions 240 can also be controlled through the use of spacing fibers 830, as shown in FIG. 8*a*. For example, as shown in the example 100G of FIG. 8*a*, a twisted fiber 100 can be coiled around a core 510 (e.g., a mandrel a mandrel or central core having one or more material as discussed herein) and can be wrapped alongside a spacing fiber 830 that serves as a spacer for the twisted fiber 100. The spacing fiber 830 can be disposed between respective coil portions 240 and prevent the coil portions 240 from coming into contact with each other. This approach can offer a way to control the coil-coil spacing in the coiled fiber 100. FIG. 8*b* shows a remaining coiled fiber 100 after removal of the spacing fiber 830 and core 510. As discussed herein, the spacing fiber 830 and core 510 can be removable in various suitable ways, including dissolution via solvent, physical removal, or the like.

Figure 9B:
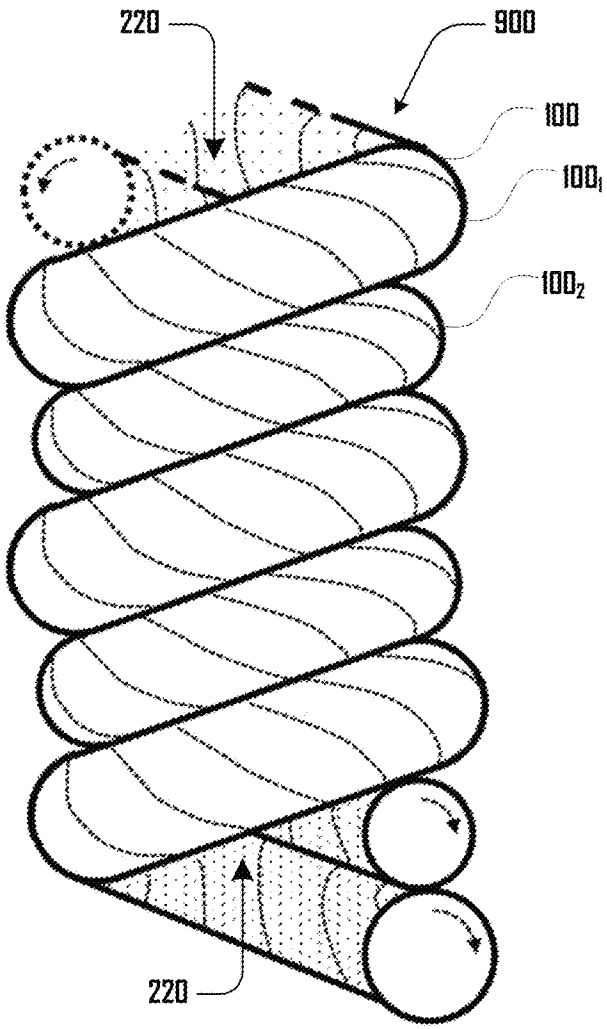
FIG. 9*b* illustrates the two coiled fiber or yarn actuators that are produced after removing the mandrel or central core of FIG. 9*a*. The two coiled actuators are illustrated nested within each other.
Figure 9A:
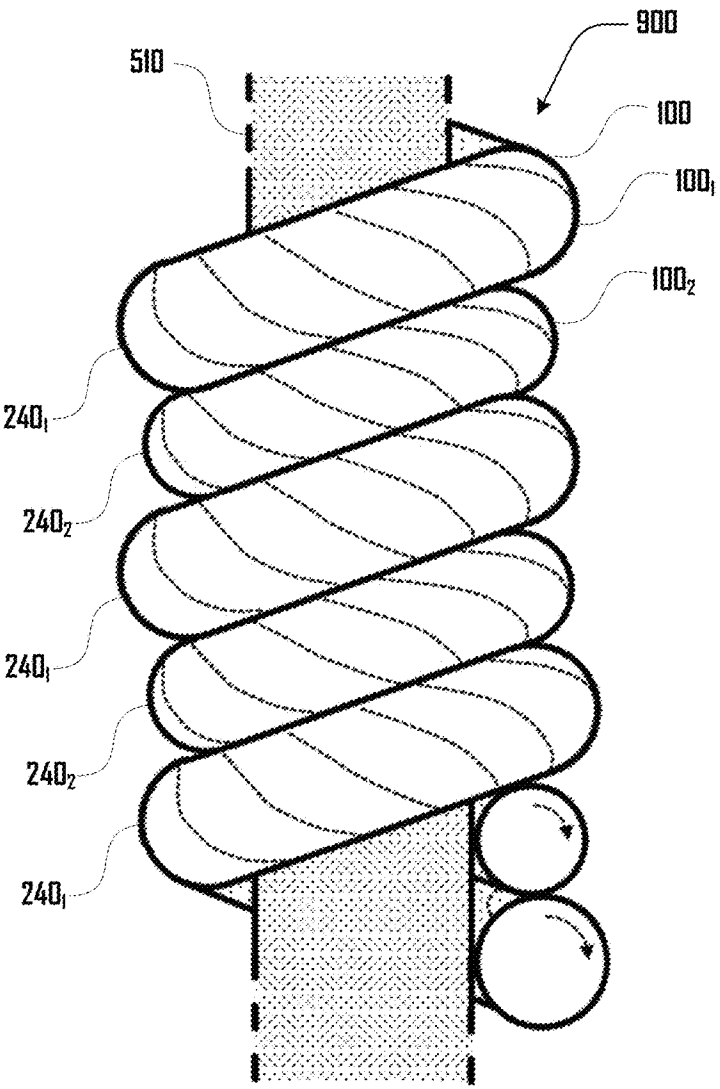
FIG. 9*a* illustrates two twisted fibers or yarns coiled around a mandrel or central core.

FIG. 9*a* illustrates a first and second twisted fiber $\mathbf{100}_1$, $\mathbf{100}_2$ coiled around core 510 (e.g., a mandrel), with the two twisted fibers $\mathbf{100}_1$, $\mathbf{100}_2$ sitting alongside each other. FIG. 9*a* shows a structure 900 comprising the two fibers $\mathbf{100}_1$, $\mathbf{100}_2$ wrapped around the removable core 510 and FIG. 9*b* illustrates the structure 900 of the two nested coiled actuator fibers $\mathbf{100}_1$, $\mathbf{100}_2$ after being released from the core 510. The two fibers $\mathbf{100}_1$, $\mathbf{100}_2$ are illustrated to show the twist and both coils are shown as homochiral coils. In the example structure 900 of FIGS. 9*a* and 9*b*, the second fiber $\mathbf{100}_2$ is shown having smaller size of about 80% of the first fiber $\mathbf{100}_1$. In further examples, the two fibers $\mathbf{100}_1$, $\mathbf{100}_2$ can be the same size, or can be and suitable different size or diameter. In some embodiments, when exposed to a change in environmental condition, such as a decrease in temperature, the structure comprising 900 the two nested coil fibers $\mathbf{100}_1$, $\mathbf{100}_2$, shown in physical contact with each other in FIGS. 9*a* and 9*b*, can respectively expand and the linear length of the nested structure 900 can increase. As with other illustrations, a portion of an example actuator is shown, but such fiber or yarn materials can have arbitrary length.

Removal of a sacrificial core 510, in part or in full, can provide a free coiled fiber actuator on a spool or inline in a process, but the sacrificial core can also be removed at the fabric or finished product stage. As one non-limiting example, a soluble sacrificial core can be used to coil a highly twisted filament, and after knitting or weaving a fabric that includes the wrapped structure the sacrificial core may be removed. In such cases, during fabric production and processing the sacrificial core can provide dimensional stability and contribute to ease of handling.

Coiled fibers 100 can be manufactured in various suitable ways. For example, a coiling machine can be used to generate a coil in a linear fiber 100 as discussed in more detail herein. In some embodiments, such a coiling machine can comprise sensors to monitor coiling of the fiber 100 and modify parameters of the coiling machine based on data from such sensors. For example, in some embodiments, it can be advantageous to monitor fiber properties and to use the real-time information to control production. The output of a sensor can be used in a feedback loop to adjust machine parameters to yield highly twisted yarns with desired geometric and mechanical properties and with minimal faults. One or more portion of a coiling machine may be individually controllable.

When a fiber 100 is twisted to the point of coiling, it can be desirable to know where along the feed path the yarn has coiled so that parameters such as yarn tension, yarn feed rate, inserted twists/m, package take up rate, or flyer rotational rate can be adjusted to prevent faults. Examples of faults can include yarn breakage, yarn snagging, or undesired or uncontrolled snarling. Some sensors can detect faults (e.g., yarn breakage) and output a signal to stop the machine or alert a technician that a fault has occurred.

One example strategy for producing coiled fibers 100 with controllable geometry is to determine a twist level along the length of the fiber 100, and adjust spindle speed, flyer speed, and/or take-up reel speed to uptake the highly twisted (and possibly coiled) yarn around a bobbin or spool. In some examples, if the twisted or coiled fiber 100 is not taken up properly around a bobbin, it can result in a fault. The twist level along the length of the fiber 100 can be determined by adding one or more sensors along the fiber path 100. Sensor output can be used in a feedback loop to adjust machine parameters to prevent faults and/or produce coiled fibers 100 with a desired geometry. Such sensors include optical sensors (e.g., CCD or camera system, encoders, laser micrometers, optical micrometers, laser interferometers, and the like), mechanical sensors (such as a spring-loaded mechanical switch, or the like), and/or electrical sensors (such as potentiometers, strain sensors, piezo sensors, and the like).

The geometry of a twisted fiber 100 can be measured during production either directly (e.g., by measuring the diameter of the twisted fiber 100) or indirectly (e.g., by measuring other properties that are correlated with the geometry of the twisted fiber 100). Sensor output can be used in a feedback loop to adjust machine parameters (e.g., tension, twisting speed, feed rate, take up rate, and the like) in real-time until a desired twist level and geometry is produced.

Properties that can be correlated with the twist level and geometry of an active fiber 100 can include (but are not limited to) filament hue/reflectivity, luster, filament or fiber diameter (d), impedance, strain, fiber smoothness or texture, local fiber velocity, and the like. For example, highly twisted areas of the fiber 100 can have a velocity that is much lower than the velocity of the areas where there are low twist levels. If a conductive filament or fiber 100 is being twisted, Hall effect sensors can be used in some embodiments.

In various embodiments, one or more tension sensors or feeders can be placed along a fiber path and data from such sensors can be used to control the geometry of the twisted fiber during manufacturing. Highly twisted fibers 100 can experience axial contraction, which can increase the tension in the fiber 100 in some examples unless the feed rate is adjusted to compensate for the axial contraction. Sensors that measure coil geometry (either directly or indirectly) and/or a related process control system can be added to machines that impart a false twist or to machines that impart a real twist in fibers 100.

Sensor output, such as the size of a fiber 100 at a given position along the fiber path, can feedback into a process control of the machine and can inform the take-up speed, tension, twisting rate, feed rate, or other process variables. In some embodiments it can be advantageous to consider the output of a plurality of sensors along the fiber path and/or the output from one or more process measurements, such as fiber size, fiber velocity, tension, and ambient conditions such as temperature and humidity. Some sensors, such as cameras, can provide more than one piece of information, for example indicating both fiber diameter (d) and fiber velocity.

As a non-limiting example, sensors can be used to monitor and control twist level in the production of a highly twisted filament, yarn or fiber 100. The fiber bias angle fiber can contribute to the performance properties of a fiber or yarn actuator, and the twist level in a filament, fiber, fibers, or yarn, can be monitored during production and provide feedback important for the control of the twisting process and the fiber bias angle $\alpha_{fiber}$ that is produced. For example, twist information can be used to change the uptake rate or tension on the fiber. A camera is one example of a sensor that can offer information on the twist level of the filament, which can be via a determination of the fiber diameter (d), which can get thicker upon twisting; via a direct measurement of the fiber bias angle $\alpha_{fiber}$, or via another suitable method.

In another non-limiting example, sensors can be used to monitor the coiling of an environmentally responsive actuator fiber 100 and can provide information useful in the control of the production of a coiled fiber 100. For example, a camera or other suitable vision system can offer information on the twist level of the fiber 100 and can be used to monitor twist level of the fiber 100 prior to coiling; can be used to monitor the rate or coiling or position of coiling along the fiber 100 and such information can be used in determining an appropriate rate of uptake for the coiled fiber 100 and/or in adjusting tension. In some embodiments, such a system can determine a coil diameter (D), which can be important in the ultimate properties of the fiber 100 in some examples, and can provide coil diameter information to a control system of the machine to increase or decrease tension, which can directly impact the coil diameter (D) as a coiled fiber 100 is produced.

A variety of information from sensors, directly monitoring the process or monitoring ambient conditions, can be integrated into a control system of a coiling machine. As a non-limiting example, ambient humidity, temperature measurements, and the like, can be used with in-line process measurement of the coil diameter (D) to provide information on the control of tension and/or uptake rate of the fiber 100 being processed.

Figure 10:
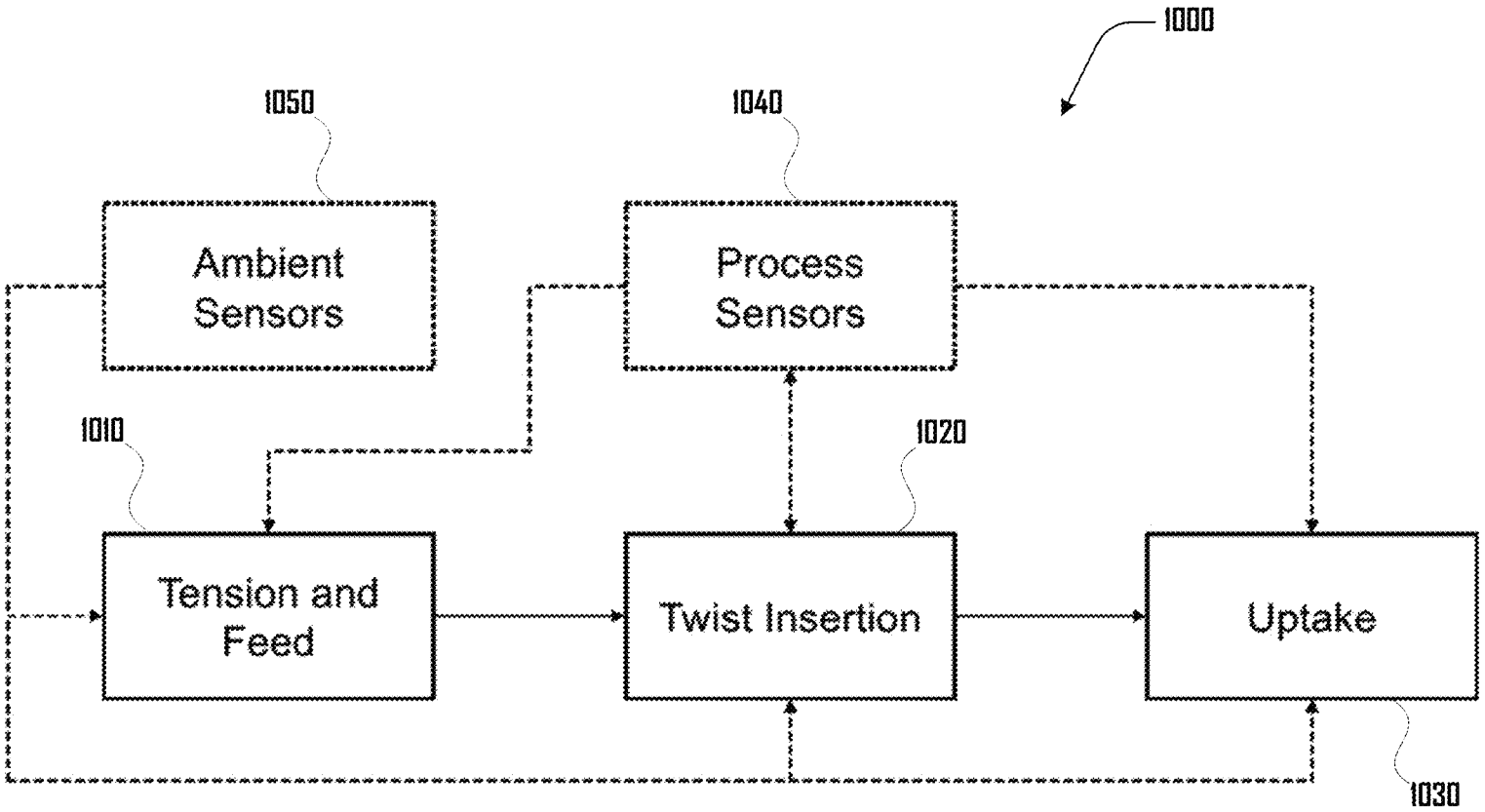
FIG. 10 illustrates an example production process for twisted fibers that includes process monitoring and feedback.

For example, FIG. 10 is a diagram of a production method 1000, which in some embodiments can be monitored and controlled by sensors to make the process automated in part or in whole such that user interaction is not necessary for some or all portions of the method 1000. At 1010, fiber or yarn from a source is tensioned and fed into a position where the material is twisted at 1020. Twisted and possibly coiled fiber or yarn can then be taken up onto a bobbin or spool at 1030. The three stages 1010, 1020, 1030 are illustrated in boxes with solid lines surrounding them, and the material transfer from tension to twist to uptake is shown through solid arrows. Process sensors 1040 and ambient sensors 1050 are represented in boxes with dashed edges and the dashed arrows shown between the various boxes illustrate feedback for control of stages 1010, 1020, 1030.

As an example of how a sensor (e.g., sensors 1040, 1050) can impact process conditions and control, environmental sensors monitoring temperature and humidity can inform a set point for tension of the fiber, and a feeder can allow more material to enter into a twisting zone if the tension becomes too large. In other words, in some examples, data from one or both of the sensors 1040, 1050 can be used to determine and implement a tension setting and/or feed rate for the fiber, which can include increasing or decreasing tension and/or increasing or decreasing a feed rate. Such a feed rate can include feeding from a fiber source and/or feeding to a twisting zone. For example, under some environmental conditions it can be desirable to increase or decrease a twisting rate, and so temperature and/or relative humidity data from ambient sensors 1050 can inform twist rate.

In some embodiments, a sensor monitoring the process 1040, (e.g., a camera), can provide information for the control of the both the tension 1010 and uptake rate 1030. As a non-limiting example, the process sensor(s) 1040 can comprise a vision system such as a camera, which can be used to monitor the formation of a coil in a fiber during a process where a highly twisted fiber is further twisted to induce coiling. Prior to coiling, the fiber or yarn can have a certain thickness that the vision system can see and measure through a pixel count or other suitable process as a part of an image analysis. Twist insertion can change the thickness of the fiber, but coiling can change the effective thickness of the fiber dramatically, increasing the pixel count across the width of the material.

If a coil is nucleated in the twist process, additional inserted twist can grow the coil and propagate the coil through the twisted fiber or yarn. Within the field of view of the vision system, image analysis can be used to determine the presence of a coil, and by comparing frames in a video, the velocity of the advance or retreat of the coil can be determined. As the coiled fiber or yarn is taken up onto a spool or bobbin at 1030, if the uptake rate is too high, the coil might move out of the field of view of the process sensor 1040 (e.g., out of view of a vision system). Alternatively, if the uptake rate is too low, the propagation of the coil might proceed through the entire field of view of the process sensor 1040 and the coil structure can move back in the system toward the tension feeder. The migration of the coil propagation back toward the tension feeder and the migration of the coil propagation forward toward the uptake bobbin can be undesirable. Accordingly, information from the process sensor 1040 (e.g., an image or video analysis of data from a camera or other vision system), can be used in the control of the process to keep it stable. In other words, data from a process sensor 1040 can be used to control variables such as tension, feed rate, twist rate, uptake rate, and the like, to maintain a coil nucleation point at desired location or within a desired location range.

Figures 11A, 11B, 11C:
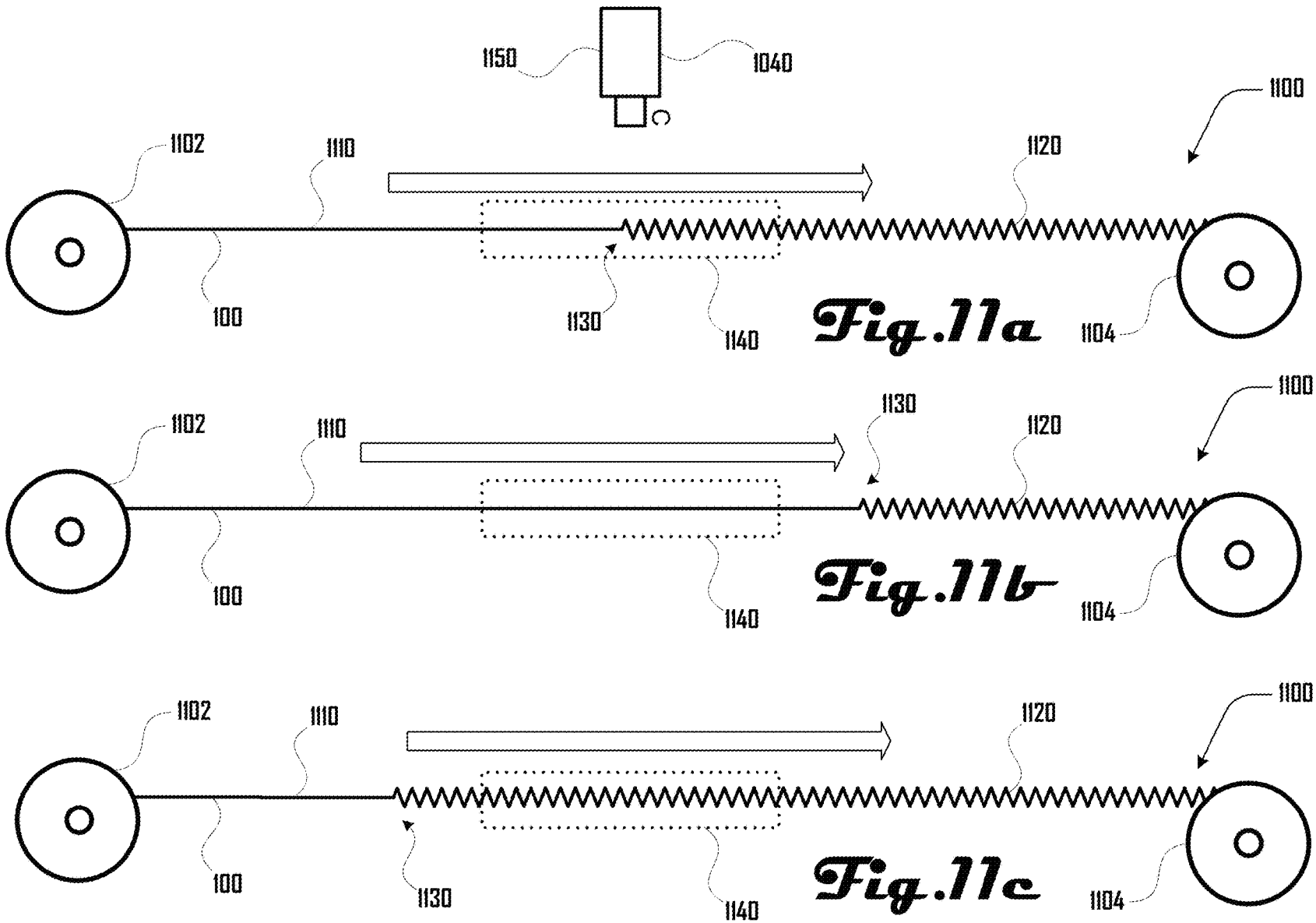
FIG. 11*a* illustrates an example of a fiber coiling system that includes a fiber source spool that feeds a fiber to an uptake spool that receives and winds the fiber.
FIG. 11*b* illustrates the fiber coiling system of FIG. 11*a* where a coil nucleation region has propagated toward the uptake spool compared to FIG. 11*a*.
FIG. 11*c* illustrates the fiber coiling system of FIG. 11*a* where a coil nucleation region has propagated toward the source spool compared to FIG. 11*a*.

For example, FIG. 11*a* illustrates an example of a fiber coiling system 1100 that includes a fiber source spool 1102 that feeds a fiber 100 to an uptake spool 1104 that receives and winds the fiber 100. It should be noted that the configuration of the fiber coiling system 1100 of FIG. 11*a* is only an example of one configuration of such a fiber coiling system 1100, and any other suitable fiber sources, fiber uptake and tensioning elements are within the scope and spirit of the present disclosure.

As further shown in FIG. 11*a*, the fiber 100 can comprise a linear portion 1110 that comes off the source spool 1102 and a coiled portion 1120 that is wound onto the uptake spool 1104. A coil nucleation region 1130 separates the linear and coiled portions 1110, 1120 and is a location where the linear portion 1110 of the fiber 100 becomes the coiled portion 1120 as the fiber is moving from the source spool 1102 to the uptake spool 1104. Additionally, FIG. 11*a* illustrates a coil nucleation window 1140 which can be monitored by one or more process sensor 1040, such as a camera 1150 as shown in the example system 1100 of FIG. 11*a*.

The coil nucleation window 1140 can comprise a desirable location in which the coil nucleation region 1130 should be positioned. As the fiber 100 is moving between the source and uptake spools 1102, 1104 and becoming coiled at the coil nucleation region 1130 on the fiber 100, the coil nucleation region 1130 can propagate toward the uptake spool 1104 (e.g., as shown in FIG. 11*b*) and can propagate toward the source spool 1102 (e.g., as shown in FIG. 11*c*), which can potentially move the coil nucleation region 1130 out of the coil nucleation window 1140 (e.g., as shown in FIGS. 11*b* and 11*c*). Accordingly, the system 1100 can monitor the location and movement of the coil nucleation region 1130 via the one or more process sensor 1040 and adjust the operating configuration of the system 1100 in real time to maintain the coil nucleation region 1130 within the coil nucleation window 1140 and/or to move the coil nucleation region back into the coil nucleation window 1140.

As an example, if the propagating coil portion 1120 moves toward the uptake bobbin or spool 1104, the rate of uptake at the update spool 1104 can be reduced to move the coil nucleation region 1130 toward the source spool 1102. In another example, if the propagating coil portion 1120 moves toward the fiber feeder spool 1102, the uptake rate at the uptake spool 1104 can be increased. By monitoring the velocity of the coil nucleation region 1130, and not just the position of coil nucleation region 1130, it can be possible adjust the uptake rate at the uptake spool 1104 in accordance with the propagation rate of coil nucleation region 1130 propagation. However, in further embodiments, adequate process stability can be achieved through only the identification of the position of the propagating coil nucleation region 1130. In some embodiments, the uptake rate at the uptake spool 1104 can be kept at a constant value and a change in the location and/or rate of the propagation of the coil nucleation region 1130 in the production process can feed back on the control of the twisting rate of the fiber 100, which can increase twist to coil more rapidly, thereby moving the coil nucleation region 1130 propagation away from the uptake spool 1104 and toward the fiber source spool 1102. In further embodiments, decreasing the twisting rate of the fiber 100 can reduce coiling rate and can move propagation of the coil nucleation region 1130 away from the fiber source spool 1102 and toward the uptake spool 1104.

As another example, a process sensor 1040 in the production method 1000 as illustrated in FIG. 10 can provide information to the control system to influence the geometry of the coiled fiber 100 that is produced by the system 1100. As an example, image or video analysis of data from a camera 1150, or the like, can be used to determine a coil spring index (C) of the coiled material by referencing the fiber diameter (d) to the coil diameter (D) (see FIGS. 1 and 2), both of which can be measured in various suitable ways (e.g., through pixel counting across an image or frame of the material during processing). In some embodiments, the coil spring index (C) can be a relative measure, not an absolute measure, so referencing pixel counts can be one simple way to determine the coil spring index (C) and partially understand the geometry of the as-formed coil portion 1120. Accordingly, in some examples, a calibration may not be needed. In various embodiments, if the monitored or determined coil spring index (C) is found to be too small or below a defined minimum coil spring index threshold, tension of the fiber 100 can be reduced. Alternatively, if the monitored or determined coil spring index (C) is found to be too large or above a defined maximum coil spring index threshold, tension of the fiber 100 can be increased.

Figure 12B:
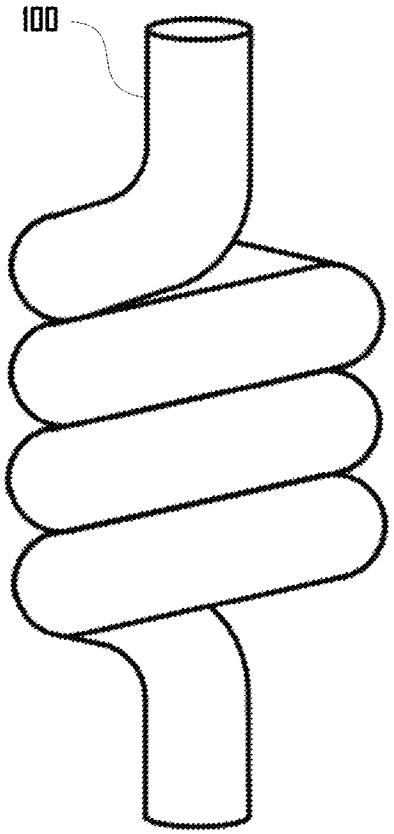
FIG. 12*b* is an illustration of a cylindrical snarl that can be produced in a fiber or yarn through the insertion of twist.

It can be desirable in some embodiments to increase production rate of a twisted coil actuator. However, in some examples, high twisting speeds can increase the likelihood of the fiber forming an undesirable kink or normal snarl (see FIG. 12*a*), instead of a cylindrical snarling that produces a coil (see FIG. 12*b*). Higher tensions on a fiber 100 can reduce the likelihood of kinking due to twist liveliness (the formation of normal snarl) in some examples, but higher tensions can produce a tighter coil in a fiber 100 with a smaller spring index (C).

Figure 12A:
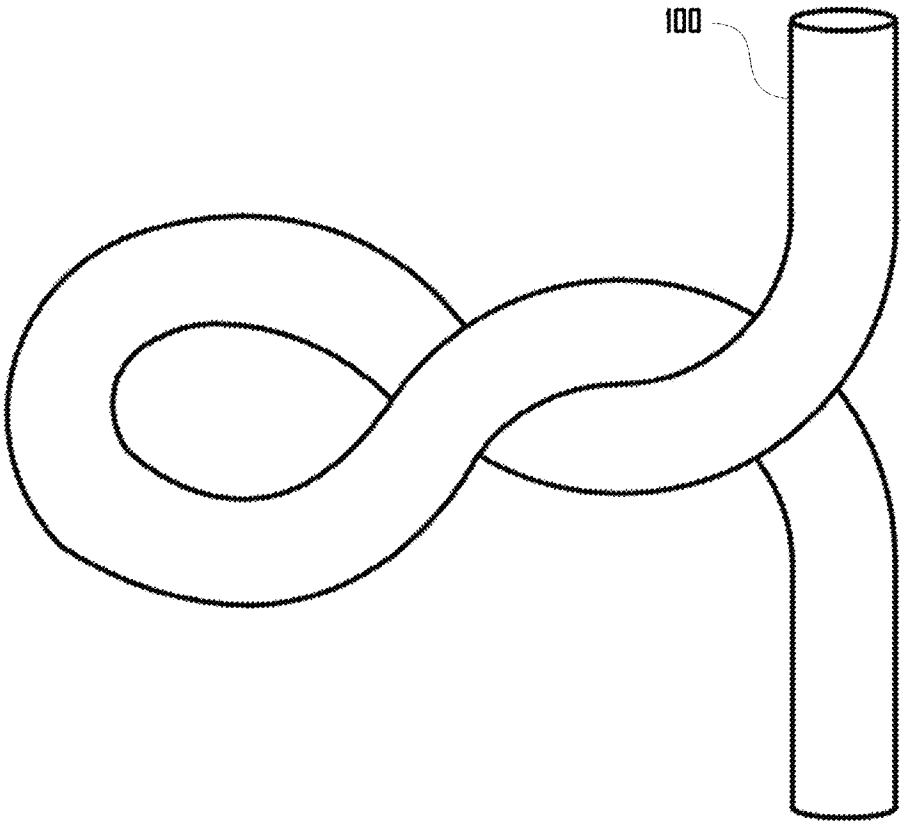
FIG. 12*a* is an illustration of kinking or normal snarl that can be produced in a fiber or yarn through the insertion of twist.

An alternative example approach can be to limit the physical space afforded to the twisting fiber 100 so that the fiber 100 does not have the physical space required to undergo the distortion associated with forming a kink or normal snarl (see FIG. 12*a*). Both normal and cylindrical snarling can require the fiber 100 to undergo a physical distortion in some embodiments, but a kink or normal snarl can sit orthogonal to the stretch direction of the fiber, requiring more space in some examples. By limiting the space afforded to the snarling fiber or yarn, for example, through the use of a constraining tube, or the like, it can be possible in some examples to retain enough physical space for cylindrical snarling to occur, while at the same time removing the space that would be required to form a kink or normal snarl.

For example, in some embodiments, a coiling machine 100 can comprise a constraining tube through which the fiber 100 extends, with the constraining tube having an internal diameter that is greater than or equal to a desired coil diameter (D) or maximum coil diameter, and less than or equal to a diameter or width of a kink or normal snarl that can be alternatively generated by the fiber 100.

As discussed herein, coil geometry and/or coil spacing can influence properties of twisted and coiled actuators for various embodiments of the actuators. However, control of coil geometry and/or spacing can be achieved in various suitable ways. For example, one approach can be to control production temperature and/or moisture levels during production. Just as it can be advantageous to utilize different tensile loads during twisting and untwisting in some examples, it can be advantageous to utilize different temperatures (or moisture levels) during twisting and untwisting steps in some examples. Alternatively, it can be advantageous to alter tension in response to temperature.

In various embodiments, one or more coiled fibers 100 as discussed herein can define a coiled fiber actuator that can be responsive to environmental conditions such as temperature, humidity, moisture, or the like. For practical use of such coiled fiber actuators, in some embodiments it can be desirable to control the thermal response (e.g., the stroke, Δlength/Δtemperature) and/or the range or limit of temperature response. For a given fiber material, the magnitude of the thermal response can be influenced by the geometry or structure of the coil, including the coil bias angle $\alpha_{coil}$ and the coil diameter (D) or openness of the coil (e.g., a larger coil diameter (D) which can give rise to a large coil spring index (C) and such a coil can have a larger thermal response). Additionally, one end of the range of temperature response can be controlled through the spacing of the coils (e.g., once the coil portions 240 come into contact with each other the contraction of the coiled actuator requires compression of the material and the magnitude of the thermal response can be greatly diminished).

For practical use of coiled actuators, in some examples it can be desirable for such coiled actuators to have a desired thermal response (e.g., amount of actuation for a given change in temperature, Δstrain/ΔT) and it can be desirable for such coiled actuators to respond over a temperature range that is relevant for the application. In some cases, it may be advantageous to have control over the range of motion, as well, a minimum effective length (e.g., at a certain temperature) and a maximum length (e.g., at another temperature), with actuation effectively occurring only between those two temperatures and two lengths.

For some embodiments of thermal actuators with negative coefficients of thermal expansion, those that have fiber and coil twist in the same direction (e.g., homochiral coils), at and above a certain temperature the coils can come into contact with each other (coil contact temperature), reaching an effective minimum length for the actuator. In various examples, a homochiral coiled fiber actuator will have physical space between its coils when its temperature is below its coil contact temperature. Artificial muscles can be used in robotics applications where they can move a mass. In these applications, initially loading the coiled actuator can stretch the actuator's coils and can pull them apart, allowing the load to be lifted on contraction of the actuator. However, in applications where the actuator is not pre-stretched or pre-loaded, it can be necessary in some embodiments for the coiled fiber to actuate within the temperature range of interest. For applications in garments and others where actuation can be desired near body temperature, the actuator may not reach a state of compression in some examples, where the coils are in contact with their neighbors, until a temperature outside of the desired active range, allowing motion across the entire range of interest. However, some existing methods for producing coiled actuators yield actuators that require cold temperatures (e.g., less than 10° C.) to lengthen when the actuators are unloaded, as they might be in some apparel examples. Control over the physical spacing between coils and the coil contact temperature where neighboring coils touch and large response to temperature drops off, can be important for the production of a coiled fiber actuator that is practical for actuating textiles, especially for apparel and bedding.

In various embodiments, controlling the spacing 260 between coil portions 240 can be used for controlling the coil contact temperature, the temperature above which some coil actuators can be effectively inactive. To increase spacing 260 between coil portions 240, the residual excess twist and compressive stress in the as-produced coils can be reduced or removed through untwisting as described above. Coiled fiber actuators can be heat set (e.g., annealed) and the setting conditions can also contribute to the spacing between coils. The coil can be, by design, temperature responsive, and can respond to the large temperature applied during heat setting, which, depending on the material, can exceed 200° C. in some examples. Depending on the specific anneal conditions (e.g., time, temperature, the presence of any facilitating agents such as water, and the like), some amount of residual compressive stress in the material can be removed in some examples. Any portion that remains or is produced through the heat setting can influence the coil spacing in various embodiments.

Heat setting can be performed at various suitable temperatures and for various suitable times. For examples, in some embodiments heat setting can be performed at 140° C., 170° C., or 200° C. In further examples, heat setting can be performed at temperatures less than or equal to 150° C., 140° C., or 130° C. and the like. In still further examples, heat treating can be performed at temperatures greater than 100° C., 110° C., 120° C., 130° C. or 140° C. Temperature ranges for such heat treating can be within a range between any of these example temperatures. In some examples, coiled actuators can be heat treated within a desired temperature range for various suitable time periods, including 15 minutes, 30 minutes, 1 hour, 2 hours, 3 hours or 4 hours. Additionally, heat treating can be performed within a suitable range bounded by any of these example time periods.

For the same heat set conditions, three non-limiting example cases are described herein. A first example is a case where the fiber actuator is free to move during the setting procedure. The high temperature of the process can cause the coil to compress, and then the actuator can be set in that compressed position. Coming out of the heat setting procedure, as the temperature cools, the coil can have a tendency to expand, but any residual compression may work against that coil expansion in some examples and the coils may still be in contact with each other at room temperature or the temperature range of interest for the intended application.

A second example heat setting procedure physically constrains the fiber actuator during an annealing process so that the temperature increase does not physically bring the coils into tighter contact with each other. There are a number of ways to apply such constraint, for example one embodiment includes taking up the fiber actuator on a spool and constraining the entire lot of fiber during the set procedure, such as by wrapping the spool with sheeting or tape that is able to withstand the conditions of the setting procedure. After the setting process, in some embodiments, the cooled actuator coils can have a tendency to expand and can separate more than the case where the heat set actuators are free to contract during a set process. Fiber actuators that are constrained during a heat set process can have a coil contact temperature at a higher value than for similar actuators heat set without physical constraint, and the higher coil contact temperature can enable the use of the actuator, unloaded, at room and body temperatures, or at other desired temperatures. As discussed herein, body temperature can include temperatures including about 37.0° C., 38.0° C., 39.0° C., or the like, as well as temperatures commonly found at the skin or in the environment around the skin, including about 27.0° C., 28.0° C., 29.0° C., 30.0° C., 31.0° C., 32.0° C., 33.0° C., 34.0° C., 35.0° C., 36.0° C., or the like. As discussed herein, room temperature can include temperatures including about 10.0° C., 15.0° C., 20.0° C., 25.0° C., 30° C., or the like.

A third example heat set procedure can be similar to the second example in that the third example constrains the fiber actuator during a heat set process, but it does so by intentionally stretching the actuator during the process. This can further shift the coil contact temperature to a higher value in some embodiments. For each of these three cases, temperature, time, and the presence of any chemical agents that facilitate the setting of the material can be additional factors.

For environmentally responsive twisted and coiled fiber and yarn actuators, in some embodiments, if the setting procedure is modified to shift the coil contact temperature to higher values the coil can become more extended (as reflected in a larger coil bias angle $\alpha_{coil}$) at lower temperatures and the thermal response of the actuator can be diminished. For some example applications in garments and textiles it can be desirable to have both a large thermal response (e.g., $|CTE| \geq 2$ mm/m/K) and a high coil contact temperature (e.g., 20° C., in some cases more preferably 40° C.).

For coiling that is brought about through winding, untwisting can be used to expand coil diameter (D) and can influence coil spacing 260 in some embodiments. Furthermore, the spacing 260 between coils portions 240 of some embodiments can be controlled by winding the twisted, active fiber 100 around a mandrel or other core material 510 with some spacing 260 between coil portions 240 (see FIG. 7*a*) and/or by winding the active fiber 100 together with a sacrificial fiber 830 around a mandrel or other core material 510 such that the sacrificial fiber 830 acts as a physical spacer between the coil portions 240 (See FIG. 8*a*). The sacrificial material 830 can be physically removed (e.g., unwinding it from the coils), dissolved, removed by chemical means, or the like. The sacrificial material can have a diameter or size comparable to that of the twisted fiber 100 that is being coiled, or the sacrificial material 830 can be larger or smaller as a way of controlling the spacing 260 between coils in the final actuator fiber 100.

In some embodiments, the coil contact temperature can be used to limit the range of motion of the actuator. In some applications it can be advantageous to limit the minimum length of the actuator, and by controlling the coil contact temperature the minimum length can be set to that temperature and any higher temperatures. While there can be some change as temperatures continue to increase in some examples, the change can be much smaller as the coils are not free to move (this description assumes the coiled actuator expands as temperatures are reduced, as is the case for homochiral coils; heterochiral coils, where coil direction is opposite twist direction, can have the opposite behavior and can contract to a minimal size as temperature is reduced and coil-coil contact as made, and once coil portions 240 are in direct contact with neighboring coil portions 240 (see e.g., FIG. 3*b*), coil portions 240 can have a substantially reduced thermal contraction at temperatures below the coil contact temperature).

The control of the coil contact temperature can offer a type of control over the stiffness (e.g., effective modulus) of the actuator. In various embodiments, when the coil portions 240 come into contact, the actuator can become much stiffer, which can be used in a design that incorporates the fiber actuator.

In some examples, by wrapping fibers around the actuator so that the actuator is an environmentally responsive core protected within a yarn, the extension of the actuator can be controlled. As the actuating core lengthens, the outer fibers (e.g., continuous filaments, staple fibers, or the like) can be pulled into an increasingly linear orientation and can reach a point where the outer fibers are sufficiently straight to engage their resistance to tensile extension. At this point, in various examples the actuator can enter into a thermal response zone where additional extension can be greatly hindered by the wrapping fibers, effectively creating a maximum length for the actuator. Wrapping or shrouding the coiled actuators can confer a number of other benefits, in some embodiments, including improved hand feel, appearance, protection from snags, control of wicking, moisture handling, chemical resistance, overall volume of the actuating yarn, and the like. Wrapping can also be used to balance out the torque of the fiber actuator. For example, the actuator can be constrained at both ends for the twisting action of the coils to translate into a linear dimensional change with a temperature change. This constraint requirement can be eliminated if the actuator is wrapped or plied with fibers in the opposite direction of twist (e.g., a Z twisted actuator can be wrapped or plied with fibers in the S direction).

While various examples disclosed herein relate to the thermal response of the coiled actuators, these materials can be moisture and/or chemical sensitive, in addition or in the alternative, and where temperature or environmental response or adaptation is referred to it is meant to include moisture, water, and/or chemical sensitivity.

Various embodiments described herein can include monofilament or multifilament yarn. However, in further examples, staple yarns can be used to produce coiled thermal actuators. In some embodiments, individual fibers in such a yarn can be crosslinked through surface-surface interactions or the yarn, in an extended form where coils are separated, can be impregnated with a crosslinking or polymerizing agent to improve long term integrity of the thermally responsive yarn. In some examples, the yarn itself can serve as a vehicle for the distribution of a liquid polymerizing agent through wicking. Similarly, a material can be used as a coating over a staple or multifilament yarn to act as a filler or glaze. Such material can comprise a sizing agent applied as a solution or can comprise a polymer applied through a melt process. In some embodiments, this protective material can be removed after the twisting and coiling of a fiber or yarn actuator, having served as a sacrificial material that aided in the production of the actuator.

An example approach to creating coils with the desired geometry (e.g., high spring index C, low coil bias angle $\alpha_{coil}$, controlled spacing 260 between the coil portions 240, and the like) can include braiding one or more pre-twisted (but not coiled in some examples) fibers 100 with one or more sacrificial fibers. The braiding can be done with or without a core 510. The braid can be heat set and the sacrificial fibers and core can be removed through physical means, dissolution, melting, washing, chemical methods, or the like.

Another example approach to creating coils with the desired geometry (e.g., high spring index C, low coil bias angle $\alpha_{coil}$, controlled spacing 260 between the coil portions 240, and the like) can include wrapping or winding one or more pre-twisted (but not coiled in some examples) fibers 100 around one or more sacrificial fibers or yarns. The one or more sacrificial fibers can define the geometry of a central cavity 220 of the coil that is formed around the one or more sacrificial fibers. The wrapped or covered fiber or yarn can be heat set and the sacrificial fiber or fibers can be removed through physical means, dissolution, melting, washing, chemical methods, or the like, freeing the wrapped fiber coils from the core. In this example approach to actuator production, the sacrificial core can serve as a template or structure around which the fibers can be wound. The fibers or yarn used to wrap around the core can be monofilaments, continuous filament yarns, or can be staple fiber yarns, optionally prepared with a removable size and/or lubricant to facilitate the formation of the coiled structure.

In some examples, including for fine yarns that can have high spring indices, the effective modulus can be too low to achieve a desired thermal or mechanical performance. To increase the effective modulus, the coils can be wrapped around an elastic or non-elastic core during production, the core can remain a part of the yarn in the final product. The coils may also be wrapped around a multicomponent core in some examples, where part of the core can be removed after wrapping/heat setting through dissolution, by chemical or physical means, or the like.

The wrapping of one or more fibers 100 around a sacrificial core 510 can also be used in a cross yarn covering, where a first set of one or more fibers 100 are wrapped around the core 510 in one direction (S or Z), followed by an additional covering where a second set of one or more fibers 100 are wrapped in the opposite direction (Z or S) around the core 510 and the first wrapping, which can comprise the first set of one or more fibers 100. In some embodiments, both first and second sets of fibers 100 can be highly twisted, yielding a nested coiled actuator where an exterior homochiral coil with Z-twist surrounds an interior homochiral coil with S-twist, or an exterior homochiral coil with S-twist surrounds an interior homochiral coil with Z-twist, which can produce a balanced or partially balanced actuating yarn. In some embodiments, only one of the first or second sets of fibers is highly twisted and the other set of fibers can be present for support, restraint, protection, bulk, or other suitable purpose.

For fibers or yarns with smaller diameters (e.g., less than 0.25 mm), commercial wrapping or covering machinery may not be able to provide an appropriate level of twisting or coiling per linear length to produce a compact coiled actuator with a minimized coil bias angle $\alpha_{coil}$. In one non-limiting example, a wrapping machine that is able to coil <5000 coils per meter could wrap a central sacrificial fiber or yarn with highly twisted 100 micrometer filament, leaving a space of >100 micrometers between each coil. Such spacing can be left in the coiled material, but, alternatively, a second highly twisted filament (or second and third, or second and third and fourth, and so forth) can be wrapped simultaneously around the central core material, forming two coils, each nested inside the other. While the environmental response would not change due to the presence of the nested coil in some examples, the nested coil or coils can have some differences in properties. For example, the contraction range can be reduced due to the presence of a second coil. In another example, the total combined stiffness of the nested coils can be higher than that of an individual coil. In terms of production, adding a second filament may not add processing time to the coiling step in various examples and can improve reliability as the two (or more) filaments can settle against each other during the production process and effectively constrain each other.

In some embodiments, heat application may not be necessary to set the coils in a desired geometry. For example, mechanical setting through plastic deformation can be utilized. Chemical methods can also be used in some examples to remove residual mechanical stresses and set the coils in the desired geometry.

Fibers with special cross-sections, including hollow-core precursor fibers and the like, can be used to increase the insulation value and decrease the weight of some actuators produced from the fibers. In various embodiments, non-circular cross-sections can increase the surface area of the fiber 100, providing enhancement in wicking, drying, feel, and the like.

Coiled actuators or artificial muscles comprising one or more coiled fibers 100 as discussed herein can have various suitable applications in apparel, bedding, drapes, insulation, and the like. For example, in some embodiments, apparel such as a coat, sweater, or the like, can comprise an adaptive fabric comprising a plurality of coiled actuators comprising a plurality of coiled fibers 100 with a first layer of the adaptive fabric configured to surround and face the body of a wearer and a second layer configured to face the external environment of the wearer. Such a configuration can include a liner and/or outer face in which the adaptive fabric can be disposed. In other embodiments only a single adaptive layer may be used in a garment or other product.

In various embodiments, apparel comprising adaptive fabric can be configured to change configurations based on the body temperature of the wearer and/or the temperature of the external environment, which can include lofting or flattening to provide for increased or decreased insulation based on temperature. For example, where the environmental temperature is colder than a desired comfortable temperature for the immediate environment of a user (e.g., around 27° C.) an external and/or internal layer of the adaptive fabric can be configured to loft to provide improved insulation from the cold for the user, with a greater amount of loft and insulation at lower temperatures. Alternatively, where the environmental temperature is warmer than is comfortable for a user, an external and/or internal layer of the adaptive fabric can be configured to flatten to provide decreased insulation for the user.

Additionally, the adaptive fabric of apparel can be configured to change configuration based on humidity associated with the body of a wearer and direct such humidity away from the body of the wearer. For example, where a user sweats while wearing apparel comprising adaptive fabric and generates humidity, the adaptive fabric can be configured to become more porous and/or flatten to allow such humidity to escape from within the apparel toward the outside of the apparel and away from the user.

Adaptive fabric or textiles comprising a plurality of coiled actuators can be generated in various suitable ways and can have various suitable characteristics. For example, the difference in coefficient of thermal expansion (ΔCTE) between two materials is a term that can indicate a range of motion or deflection of a structure such as a bimorph or other structure having a plurality of coiled actuators. With some example materials the ΔCTE term can be 100-200 μm/m/K, which may not be desirable for some embodiments. Accordingly, various embodiments of a bimorph can comprise a highly twisted coil actuator as described herein (e.g., FIGS. 15*a*, 15*b*, 16*a*, 16*b*, 17*a*, 17*b* and 18), which in some embodiments can have an effective CTE value of 1000 μm/m/K or more, providing a ΔCTE value of the same magnitude. In some examples, such CTE values can find use in bimorph and bilayer structures having desirable deflection or bending characteristics.

In various embodiments, a coiled actuator can function as a thermally-responsive tensile actuator (linear motion) and/or a torsional actuator (rotational motion). In further embodiments, through the use of a complementary material, the structures described herein can translate linear motion of a coiled actuator into motion in an orthogonal direction. Such embodiments can be desirable for use in thermally responsive yarns, fills, felts, fabrics, or the like, which can comprise garments and other articles that thicken upon exposure to low temperatures.

In various embodiments, it can be desirable to pair materials where difference between the CTE values of the two paired materials (ΔCTE) is large. Accordingly, coiled actuators 1210 having large CTE values can be desirable for use in bimorphs and structures comprising bimorphs. In some embodiments, coiled actuators can have positive CTE characteristics (e.g., expanding with temperature increase, heterochiral coils where the twist and coil directions are opposite) or large negative CTE characteristics (e.g., contracting with a temperature increase, homochiral coils where the twist and coil directions are the same). In various embodiments, and as described herein, pairing opposing coiled actuators together comprising the same filament material can generate a larger ΔCTE.

In various embodiments, bimorphs can comprise twisted coil actuators where linear displacement of the actuator due to a temperature change can induce an out-of-plane or orthogonal deflection in the bimorph, leading to an effective change in height or thickness of the bimorph.

Figure 15A:
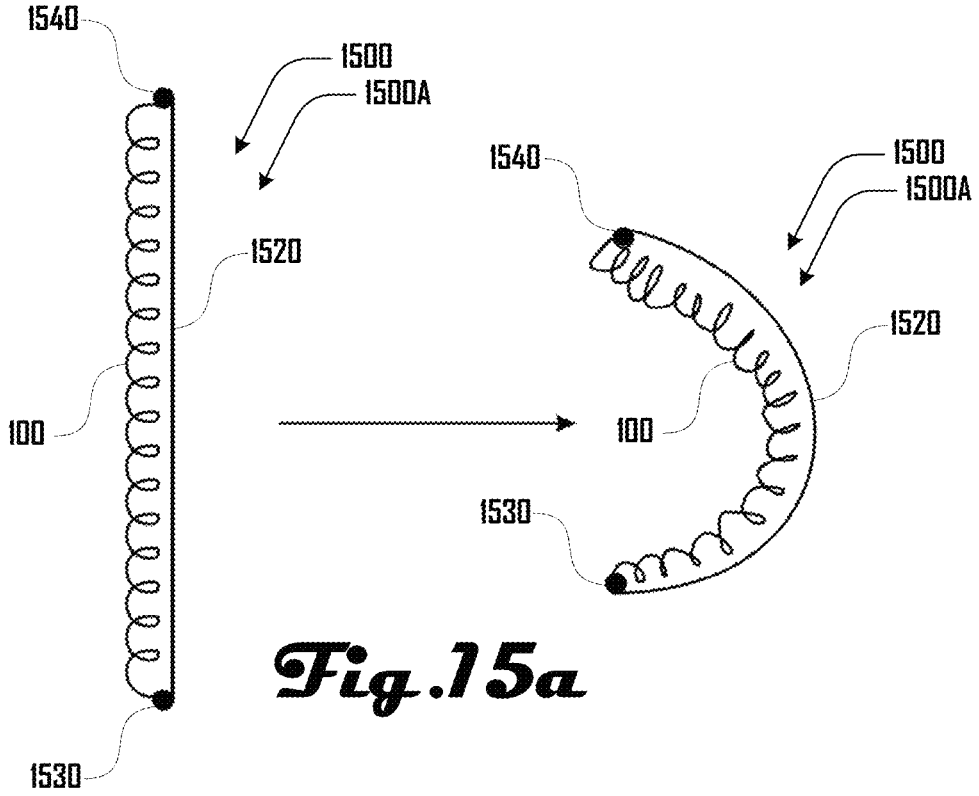
FIGS. 15*a*, 15*b*, 16*a*, 16*b*, 17*a*, 17*b* and 18 illustrate example embodiments of bimorphs that include one or more coiled fiber actuator.
Figure 15B:
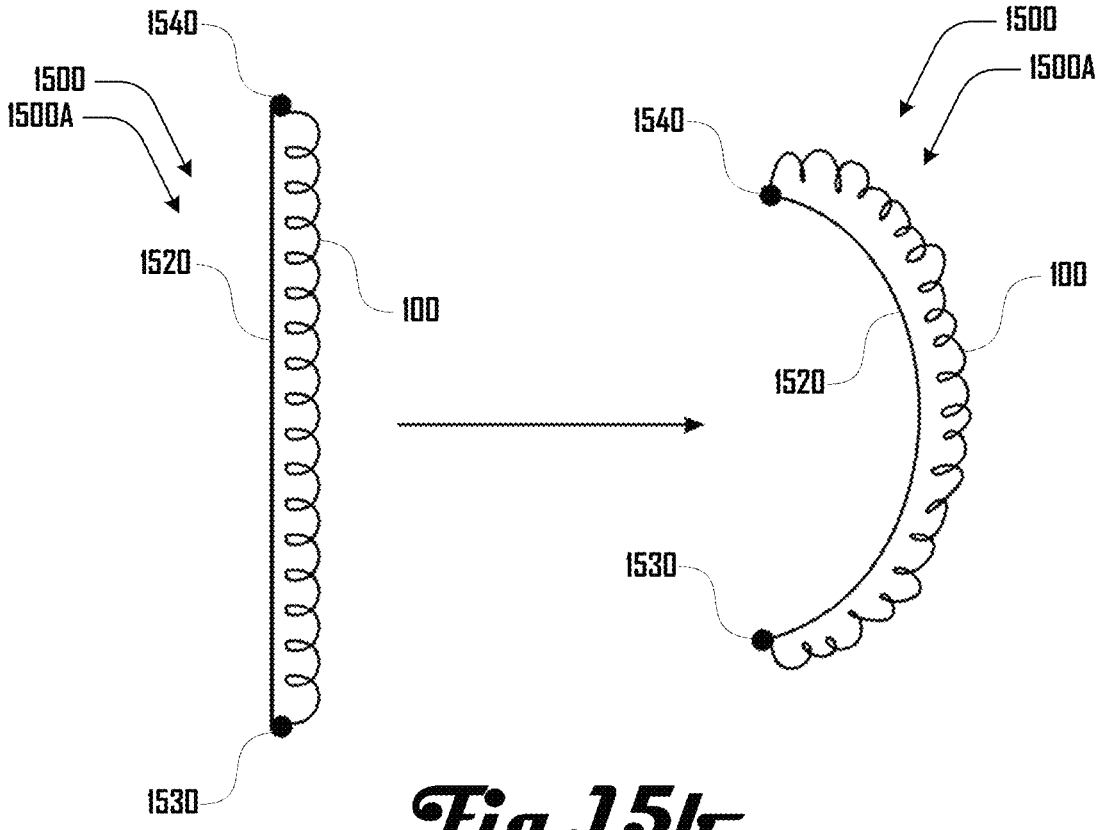

FIGS. 15*a* and 15*b* illustrate one example 1500A of a bimorph 1500 comprising a coiled actuator fiber 100 and a filament 1520 coupled at a first and second end 1530, 1540. The coiled actuator fiber 100 and filament 1520 can be only coupled at the first and second end 1530, 1540 and/or can be coupled along a portion of their lengths.

In various embodiments the coiled actuator fiber 100 can expand or contract lengthwise in response to a temperature change. For example, the coiled actuator fiber 100 can contract on cooling (heterochiral fiber actuator, twist and coil directions are opposite) or expand on cooling (homochiral fiber actuator, twist and coil directions are the same). In various embodiments, the filament 1520 can expand, contract, or exhibit no substantial change lengthwise.

FIG. 15*a* illustrates the bimorph 1500A in a flat configuration at a first temperature on the left and first contracted configuration on the right caused by a temperature change. FIG. 15*b* illustrates the bimorph 1500A of FIG. 15*a* in a flat configuration at the first temperature on the left and second contracted configuration on the right caused by a temperature change opposite from the temperature change illustrated in FIG. 15*a*. For example, FIG. 15*a* can illustrate a change in configuration based on a negative temperature change and FIG. 15*b* can illustrate a change in configuration based on a positive temperature change.

In various embodiments, the coiled actuator fiber 100 and filament 1520 can be configured to both bend as shown in the example embodiment of FIGS. 15*a* and 15*b*, with the lengths of the coiled actuator fiber 100 and filament 1520 abutting in both bent and straight configurations. In further embodiments, the coiled actuator fiber 100 and filament 1520 can be configured to bend in different ways, and the coiled actuator fiber 100 and filament 1520 may not abut in flat and/or bent configurations.

Figure 16A:
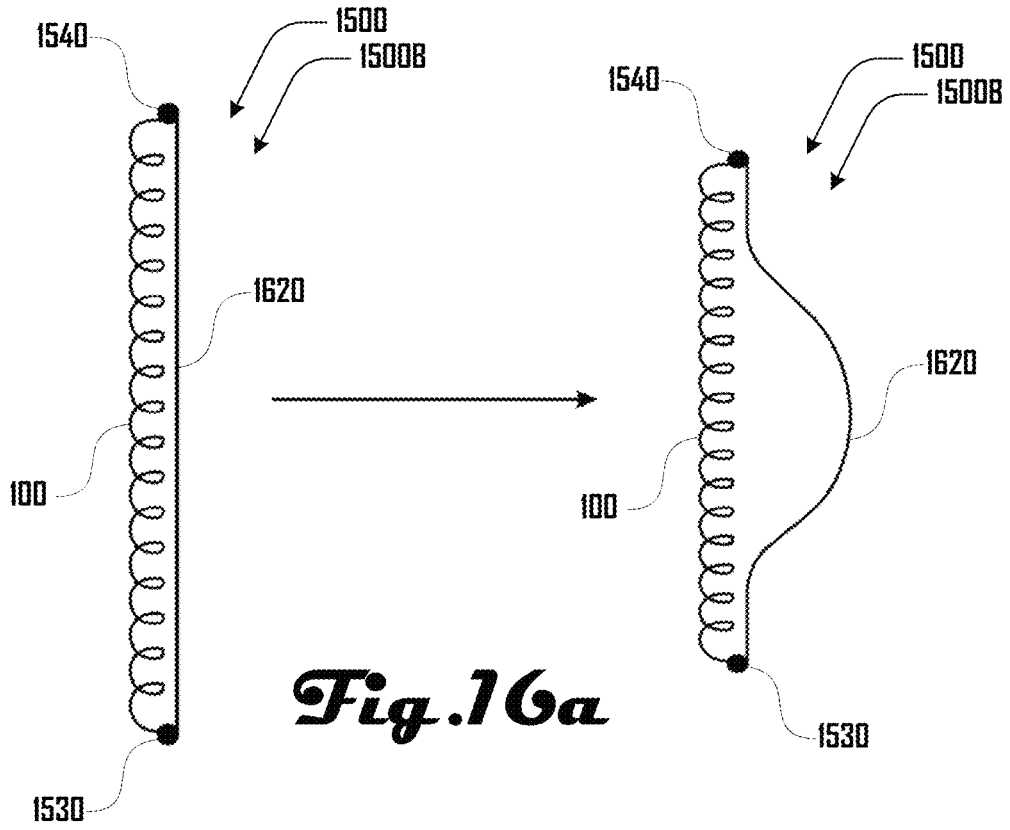

For example, FIG. 16*a* illustrates an example embodiment 1500B of a bimorph 1500 having a coiled actuator fiber 100 and filament 1620, wherein the coiled actuator fiber 100 maintains a linear configuration when the bimorph 1500 is in a flat configuration (left) and a bent configuration (right). In this example, the coiled actuator fiber 100 is shown contracting due to a temperature change, which causes the filament 1620 to bend away from the coiled actuator fiber 100.

Figure 16B:
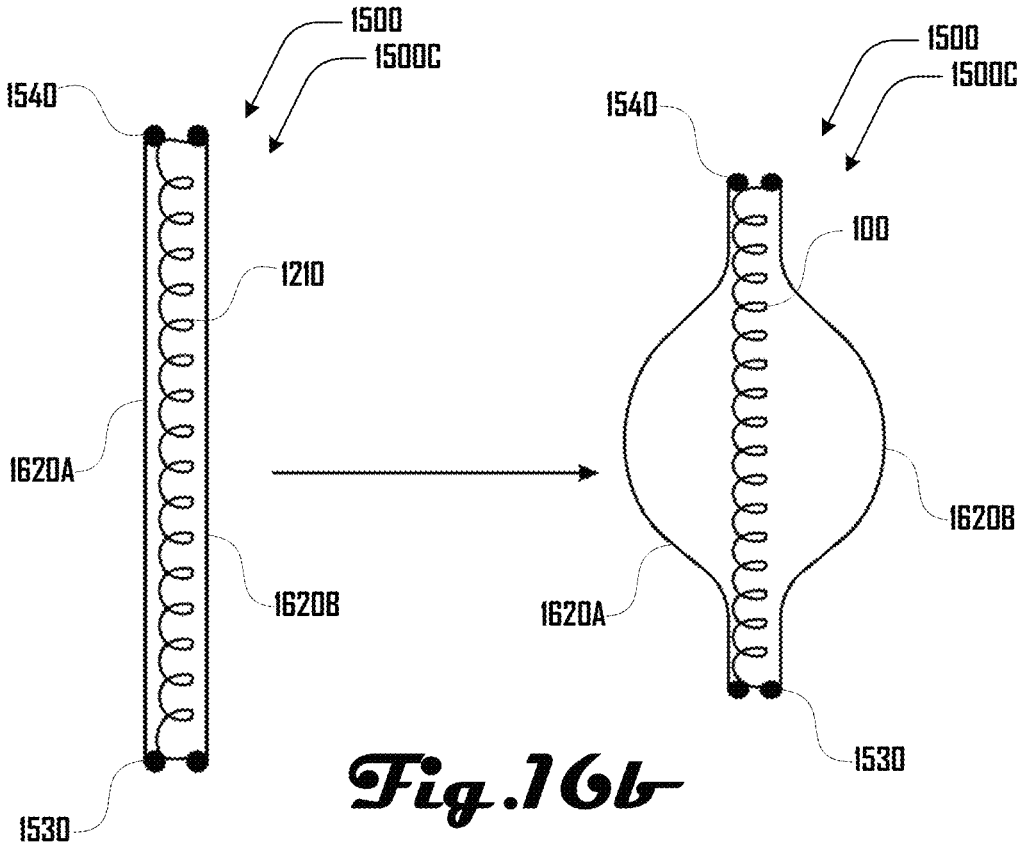

Similarly, FIG. 16*b* illustrates another example 1500C of a bimorph 1500 comprising a first and second filament 1620A, 1620B with a coiled actuator fiber 100 between the first and second filament 1620A, 1620B. In this example, the bimorph 1500C is shown contracting due to a temperature change, which causes the filaments 1620A, 1620B to bend away from the coiled actuator fiber 100, which maintains a linear configuration.

Figure 17A:
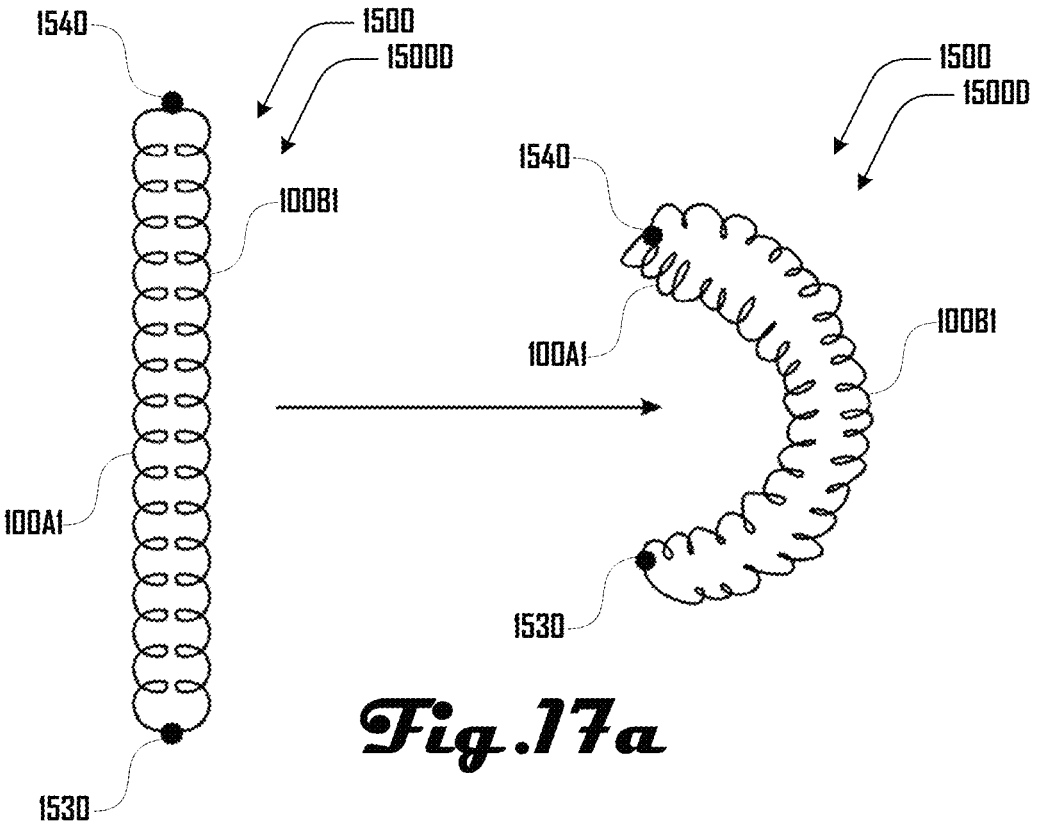
Figure 17B:
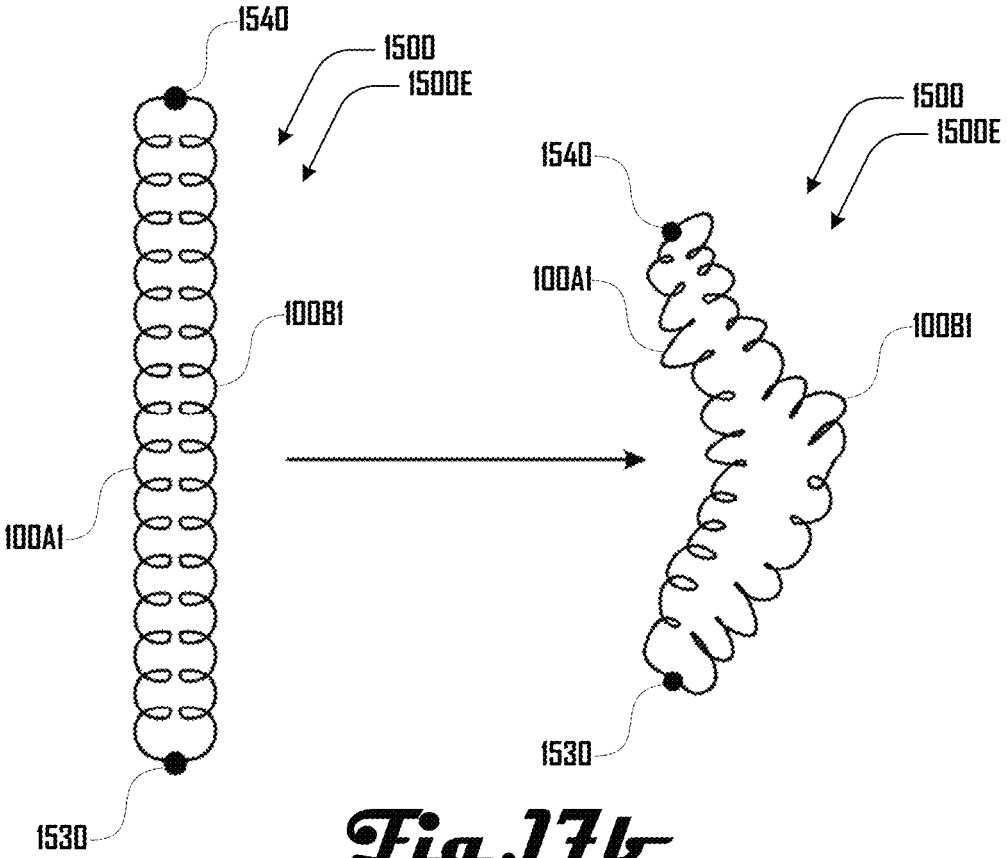

FIGS. 17*a* and 17*b* illustrate two examples 1500D, 1500E of bimorphs 1500 comprising a first and second coiled actuator fibers 100A1, 110B1 coupled at a first and second end 1530, 1540. In some embodiments, the coiled actuator fibers 100A1, 110B1 can be coupled along a portion of their length. FIG. 17*a* illustrates an example embodiment 1500D wherein the coiled actuator fibers 100A1, 110B1 have an opposing thermal response and remain adjoining in both a flat (left) and bent configuration (right). In contrast, FIG. 17*b* illustrates an example embodiment 1500E wherein the coiled actuator fibers 100A1, 110B1 are adjoining in a flat configuration (left) and can separate in a bent configuration (right).

Figure 18:
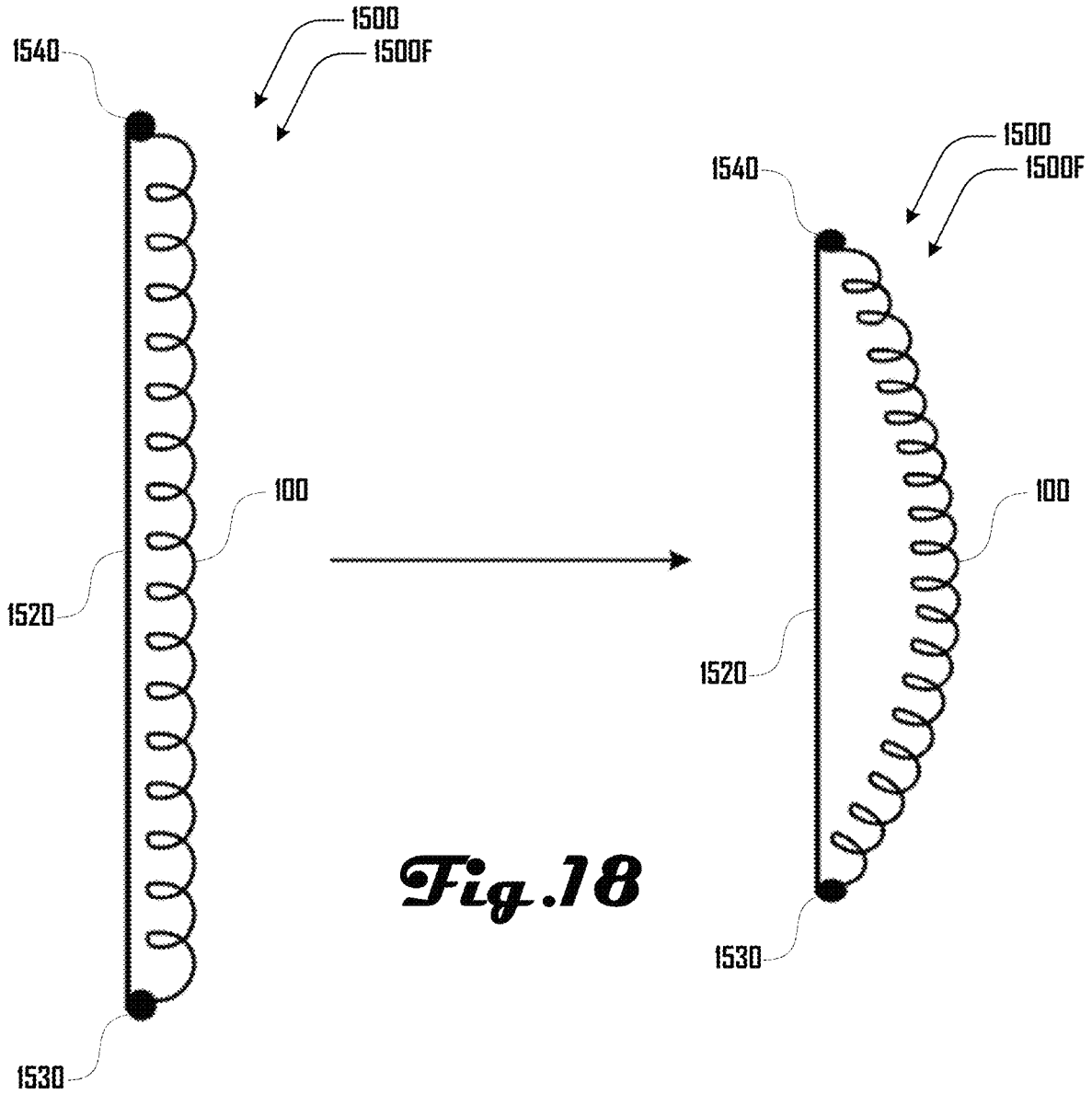

FIG. 18 illustrates an example embodiment of a bimorph 1500F having a coiled actuator fiber 100 and filament 1520, wherein the filament 1520 maintains a linear configuration when the bimorph 1500 is in a flat configuration (left) and a bent configuration (right). In this example 1500F, the coiled actuator fiber 100 is shown expanding due to a temperature change, which causes the coiled actuator fiber 100 to bend away from the filament 1520.

In various embodiments, one or more twisted coil actuator fiber 100 can be coupled with one or more rigid counter filament 1520 that can act as an immobile structure against which an actuator fiber 100 can be displaced orthogonally, creating a structure with minimal linear expansion that still changes its effective thickness. FIG. 18 illustrates one example of such a structure.

In addition to desirable effective CTE values, coiled actuator fibers 100 can offer some processing or fabrication advantages, such as mechanical connection routes not available to sheet structures and the advantage of producing both positive and negative CTE coils from the same length of material as discussed herein. The effective CTE values of the coiled actuator fibers 100 can be maximized when the spring constant for the coiled actuator fibers 100 is large, leaving an open cavity 220 at the center of the coil. Coiled actuator fibers 100 can also be desirable due to porosity, density, and breathability, and the like, which can be present in such a structure.

In various embodiments, one or more coiled actuator fibers 100 and/or bimorph 1500 can be woven or stitched through fabrics or thin films to create bimorph sheet structures with large effective ΔCTE values and corresponding large deflections. In further embodiments, one or more coiled actuator fibers 100 can be stitched or bonded to sheets to create bimorph sheets. In some embodiments, one or more coiled actuator with alternating coil segments with alternating expanding and contracting segments of opposite chirality can be stitched or bonded to the surface of a sheet or fabric. Sheet structures can be formed where the sheet or ribbon takes on a sinusoidal profile as temperature changes due to the positive and negative thermally responsive zones within the alternating-chirality coiled actuator fibers 100. Embodiments of alternating-chirality coiled actuators can have applications in a variety of fields. For example, various embodiments can be configured for production of thermally adaptive garments, where alternating chirality coils can be used in a traditional lockstitch to create alternating positive and negative CTE regions on the surface of a fabric, inducing an undulation in the fabric as the temperature changes. In some embodiments, the second yarn or fiber in the lockstitch not need to be a large-CTE or twisted coil actuator material.

In some embodiments, a plurality of coiled actuator fibers 100 can be laid out side-by-side and woven or stitched together, creating a sheet or layer with a desirable CTE in a single direction. In still further embodiments, such sheets having different CTEs (e.g., one with a large positive CTE and one with a large negative CTE) can be paired to produce flat bimorph sheets with desirable differences in thermal expansion and a desirable radius of curvature.

In further embodiments, coiled actuator fibers 100 can be stitched onto a thin-film, membrane, or fabric, which can impart thermally responsive properties to such a thin-film, membrane, or fabric. Accordingly, various embodiments can remove the need for deeper integration of the selected materials with the insulation material or fabric. In such embodiments the thermally responsive material can additionally be part of the weave, it can be the primary body of the insulation, it can be the substrate, or it can be adhered to another material through an adhesive or thermal bond.

Additionally, coiled actuator fibers 100 can be used to generate branched structures similar to those in goose down. For example, in some embodiments, by dragging a twisted fiber 100 through a layer of thin fibers during a coiling process, the thin fibers can be captured or caught in the coils, forming a branched structure with favorable insulating, tactile, and structural properties, in the larger context of a variable insulation.

A coiled actuator fiber 100 can serve as a linear or torsional actuator. In various embodiments, as discussed herein, pairing two different materials can generate out-of-plane or orthogonal motion. In some embodiments, woven or knit structures that antagonistically pair twisted coils with different CTE characteristics can comprise a thermally responsive bimorph 1500. In some embodiments, a plurality of materials can be woven together in various suitable ways to generate a gross physical structure of the weave that changes in response to temperature. Such a woven structure can comprise, coiled actuator fibers 100, or other suitable materials or structure that is changes configuration or length in response to temperature.

In various embodiments, a woven or knit structure can serve as a constraint by aligning fibers so that the overall motion is cohesive and not characterized by the random individual squirm of a disparate group of fibers, which can be desirable for a thermally adaptive material and maximizing its deflection or change in its effective thickness.

In further embodiments, temperature sensitive structures can include non-adaptive constraints such as a fiber, yarn, or fabric that the active material works against, where the non-adaptive material stays linear, straight, or flat, and the active material lofts due to expansion, or where the active material stays linear, straight, or flat and the non-adaptive material lofts due to the active material's contraction. Appropriate constraints through weaving, knitting or the use of adhesives can generate a desired temperature response in such structures. In some embodiments it can be advantageous to employ a constraint that limits the range of motion of the material.

In further embodiments, a coiled actuator fiber 100 or artificial muscles comprising one or more coiled fibers 100 can be used in various suitable ways, including one or more of: (i) a textile or braid, (ii) a mechanical mechanism for opening and closing shutters or blinds to regulate light transmission or air flow, (iii) a mechanical drive for a medical device or toy, (iv) a macro- or micro-sized pump, valve drive, or fluidic mixer, (v) a mechanical relay for opening and closing an electronic circuit or opening and closing a lock, (vi) a torsional drive for a rotating electrode used in highly sensitive electrochemical analyte analysis, (vii) a mechanical drive for an optical device, (viii) a mechanical drive for an optical device that opens and closes an optical shutter, translates or rotates a lens or light diffuser, provides deformation that changes the focal length of a compliant lens, or rotates or translates pixels on a display to provide a changing image on the display, (ix) a mechanical drive that provides tactile information, (x) a mechanical drive that provide tactile information for a haptic device in a surgeons glove or a Braille display, (xi) a mechanical drive system for a smart surface that enables change in surface structure, (xii) a mechanical drive system for an exoskeleton, prosthetic limb, or robot, (xiii) a mechanical drive system for providing realistic facial expressions for humanoid robots, (xiv) smart packaging for temperature sensitive materials that opens and closes vents or changes porosity in response to ambient temperature, (xv) a mechanical system that opens or closes a valve in response to ambient temperature or a temperature resulting from photothermal heating, (xvi) a mechanical drive using photothermal heating or electrical heating that controls the orientation of solar cells with respect to the direction of the sun, (xvii) a micro device that is photo-thermally actuated, (xviii) a thermally or photothermally actuated energy harvester that uses fluctuations in temperature to produce mechanical energy that is harvested as electrical energy, (xix) a close-fitting garment, wherein thermal actuation is used to facilitate entry into the garment, (xx) a device for providing adjustable compliance, wherein the adjustable compliance is provided by electrothermal actuation, (xxi) a translational or rotational positioner, and the like.

The described embodiments are susceptible to various modifications and alternative forms, and specific examples thereof have been shown by way of examples and are herein described in detail. It should be understood, however, that the described embodiments are not to be limited to the particular forms or methods disclosed, but to the contrary, the present disclosure is to cover all modifications, equivalents, and alternatives.

FIRST AND SECOND EXAMPLES

Figure 13:
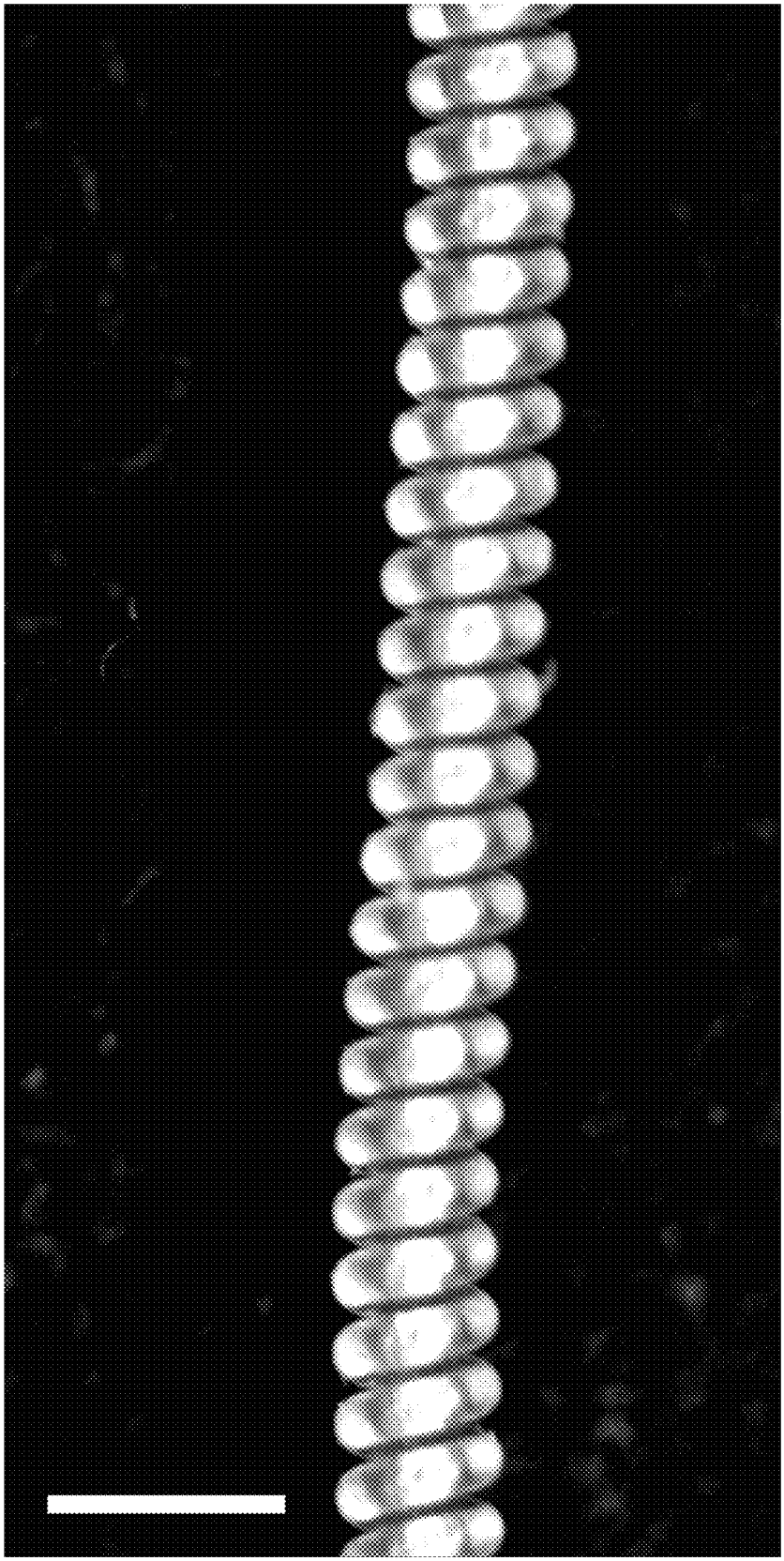
FIGS. 13 and 14 show two environmentally responsive coiled fiber actuators. The microscope images show coils with similar geometry that were produced by two different methods. The length of the scale bar is 0.5 mm.
Figure 14:
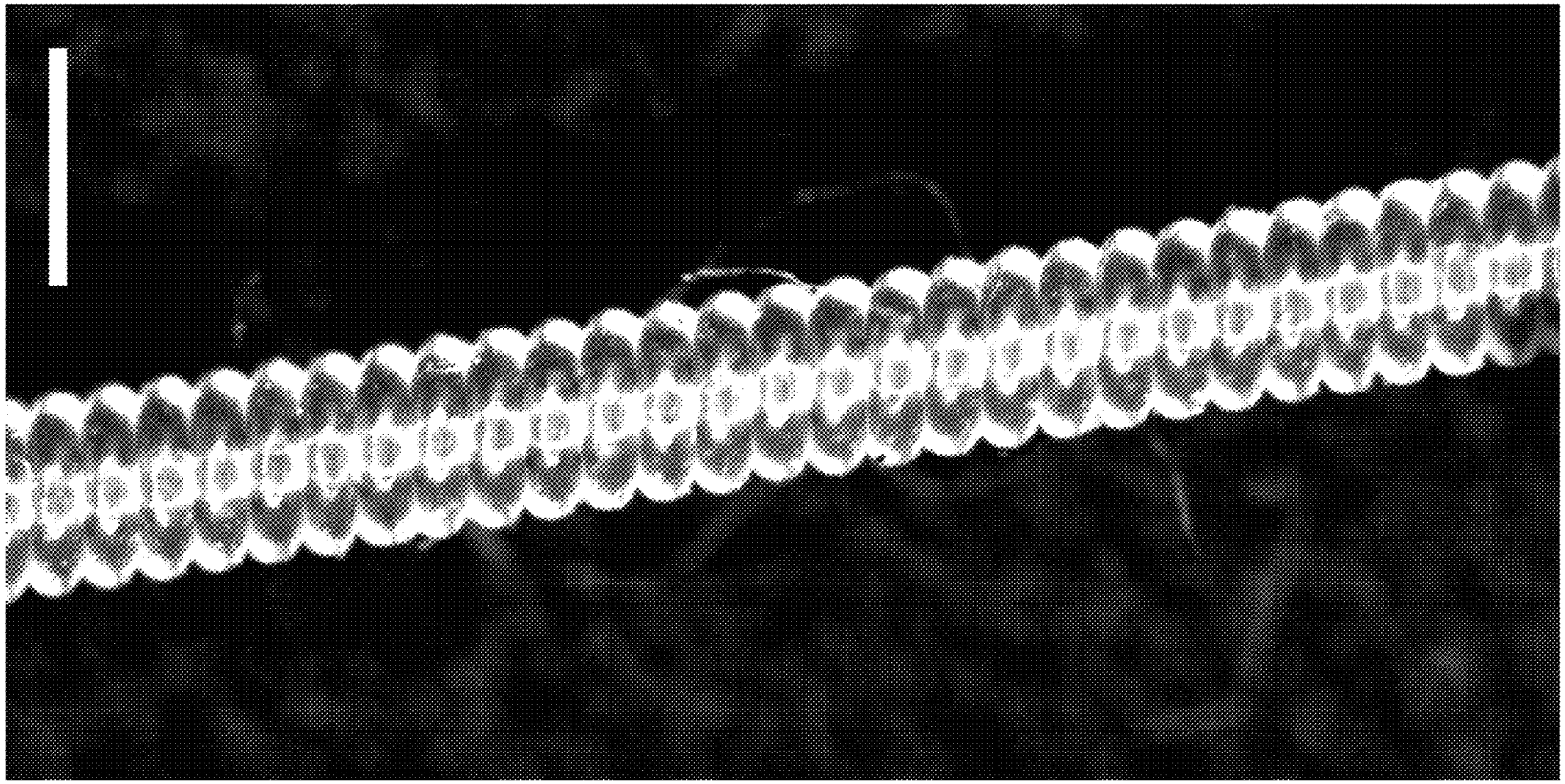

FIGS. 13 and 14 show two environmentally responsive coiled fiber actuators produced according to the methods described herein. The microscope images of FIGS. 13 and 14 show coils with geometry that were produced by two different methods. The length of the scale bar is 0.5 mm.

In FIG. 13, the highly twisted fiber coil was made from a 0.1 mm polyamide filament by twisting under tension to the point of inducing coiling, twisting the coils in the opposite direction (untwisting) under a reduced load, and heat setting. The coil index was measured and found to be about 2.9, and the linear thermal expansion coefficient in the axial direction of the fiber actuator was measured and found to be −4.2 mm/m/K.

In FIG. 14, the highly twisted fiber coil was made from a 0.1 mm polyamide filament by twisting under tension prior to the point of inducing coiling and then wrapping around a sacrificial fiber core, followed by heat setting and removal of the core. The coil index was measured and found to be about 2.8, and the linear thermal expansion coefficient in the axial direction of the fiber actuator was measured and found to be −4.6 mm/m/K. Both coiled fiber actuators were produced from the same polyamide filament and both coils were homochiral, with a negative thermal expansion coefficient, expanding upon cooling rather than heating. The coils in the coiled-by-twisting material (FIG. 13) show a small space between each other, while the coils are touching or nearly touching in the coiled-by-wrapping material (FIG. 14).

ADDITIONAL EXAMPLES

Using these techniques described above thermal actuators have been produced with CTE values with a magnitude above 5 mm/m/K (for a coil with a negative thermal expansion that means values less than −5 mm/m/K, or −0.005 per K) and actuators with magnitudes above 2 mm/m/K have also been produced. All of these example implementations actuate around body temperature and enable the production of responsive textiles appropriate for apparel applications.

Figure 19:
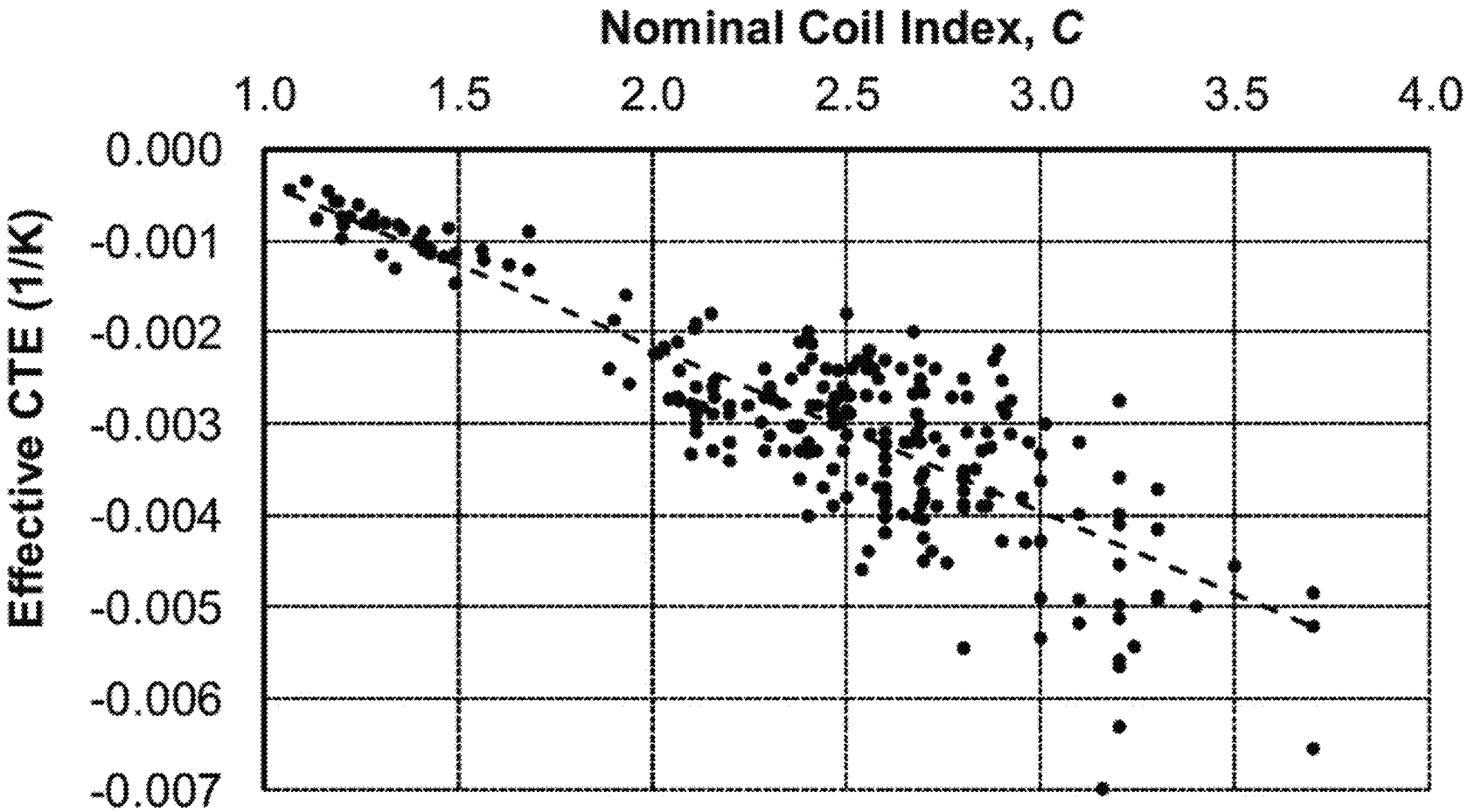
FIG. 19 presents effective linear coefficient of thermal expansion (CTE) data for over 200 example twisted and coiled homochiral fiber actuators with various coil index values (C).

FIG. 19 presents effective linear coefficient of thermal expansion (CTE) data for over 200 twisted and coiled homochiral fiber actuators with various coil index values (C). The dashed line represents a linear fit of the data ($R^2$=0.7). None of the data are for mandrel-wound or core-wrapped actuators; all of the data represent coils produced through twisting to the point of bringing about coiling. To achieve coil index values above approximately 1.75, the as-formed coils were partially untwisted, increasing both the coil index value and the magnitude of the coefficient of linear expansion. The coils with a larger coil spring index (C), in general, had a coil contact temperature high enough to allow expansion and contraction around body temperature. These coils with larger spring index, made of different materials and under different conditions, also exhibited variability in the spacing between coils and the coil bias angle, explaining some of the increase in dispersion in the data at higher values of C. The data represent coils produced from fibers in the polyamide, polyester, and polyolefin families, with various fiber or yarn sizes ranging from 0.05 mm to more than 0.3 mm in diameter. The data also represent coils heat set under a range of conditions.

Table 1 summarizes the measured thermal expansion coefficient data from a series of twisted and coiled polyester fiber actuators that were heat set at different temperatures. Six (6) fiber actuators were produced for annealing at each of the temperatures, 140° C., 170° C., and 200° C., for a total of 18 fiber actuators. The actuators were all produced under similar conditions and were nominally the same prior to the annealing step. At each temperature, half of the fiber actuators that were annealed were S-twist homochiral actuators, and half were Z-twist homochiral actuators. All three heat set conditions were appropriate for producing a large-stroke thermally responsive material, but the lower temperatures, 140° C. and 170° C., produced fiber actuators with a meaningfully larger magnitude of thermal response. Each of the heat set procedures was carried out for two (2) hours.

TABLE 1

Summary data for twisted and coiled polyester fiber actuators heat set at different temperatures.

| Heat set temperature (° C.) | 140° C. | 170° C. | 200° C. |
|---|---|---|---|
| Average coefficient of thermal expansion (mm/m/° C.) | −3.9 | −3.8 | −3.0 |
| Relative standard deviation (%) | 13.8% | 6.4% | 6.5% |

Lower temperature heat set conditions can also be used, even for materials with high melting points. For example, autoclave conditions (121° C. saturated and pressurized steam for 15-20 minutes) can be sufficient to relax some twist liveliness in highly twisted polyamides, which can reduce the tension required for reliably handling highly twisted and/or coiled material. Generally, it is desirable to heat set at temperatures above the glass transition temperature of the material, which for common polymers used in textiles, such as polyesters and polyamides, is typically less than 100° C. For polyolefin materials the glass transition temperature may be much lower, often below 0° C., and heat set temperatures less than 100° C. are often adequate.

Using the techniques described herein, twisting fiber to the point of inducing coiling has been shown to be able to produce a homochiral coiled fiber actuator with an effective linear coefficient of thermal expansion value larger than −9 mm/m/K. Additional optimization is possible, and such values are not an upper end of performance. Furthermore, methods of wrapping twisted fiber around a core can produce similar results and can enable superior control over the structure of the coil that is produced in some examples, thereby providing a route to better performance.

What is claimed is:

1. A method of generating a coiled actuator fiber comprising:

twisting a fiber to generate a twisted fiber;

wrapping the twisted fiber around a core yarn or fiber to generate a coil in the twisted fiber, which generates a coiled twisted fiber;

setting the coiled twisted fiber by heat or chemical treatment; and removing at least a portion of the core yarn or fiber to generate a coiled actuator fiber.

2. The method of claim 1, wherein at least a portion of the core yarn or fiber is removed through at least one of the following:

(a) dissolution;

(b) chemical reaction; and (c) melting.

3. The method of claim 1, wherein the direction of the wrapping is the same as the direction of the twisting.

4. The method of claim 1, wherein the direction of the wrapping is the opposite of the direction of the twisting.

5. The method of claim 1, wherein setting the coiled twisted fiber is carried out prior to the removing at least a portion of the core yarn or fiber to generate the coiled actuator fiber.

6. The method of claim 1, wherein the coiled actuator fiber comprises a coil spring index (C) greater than 1.7.

7. The method of claim 1, wherein the coiled actuator fiber comprises a thermal expansion coefficient having a magnitude of 1000 μm/m/K or more.

8. The method of claim 1, wherein space between neighboring coils of the coiled actuator fiber is such that thermal actuation of the coiled actuator fiber in an unloaded state brings the neighboring coils into contact with each other above 10° C.

9. A method of constructing a thermally adaptive fabric comprising the method of claim 1 and further including:

generating a thermally adaptive fabric including a plurality of coiled actuator fibers generated by at least a portion of the method of claim 1, wherein the coiled actuator fiber is at least partially responsible for thermal adaptation of the thermally adaptive fabric.

10. The method of claim 9, wherein the removing the at least a portion of the core yarn or fiber occurs after generating a thermally adaptive fabric including the plurality of coiled actuator fibers generated by at least the portion of the method of claim 1.

11. The method of claim 9, wherein a thermal adaptation of the thermally adaptive fabric causes the thermally adaptive fabric to increase insulation capability of the thermally adaptive fabric in response to a decrease in temperature of an ambient environment that the thermally adaptive fabric is present in.

12. The method of claim 9, wherein the thermally adaptive fabric is generated through weaving or knitting.

13. The method of claim 9, wherein the plurality of coiled actuator fibers comprise a thermal expansion coefficient having a magnitude of 1000 μm/m/K or more.

14. The method of claim 9, wherein the plurality of coiled actuator fibers comprise a thermal expansion coefficient of having a magnitude of 2 mm/m/° C. or more.

15. A method of constructing a thermally adaptive garment comprising the method of claim 1 and further including:

generating a thermally adaptive garment including a plurality of coiled actuator fibers generated by at least a portion of the method of claim 1, wherein the plurality of coiled actuator fibers are at least partially responsible for thermal adaptation of the thermally adaptive garment.

16. The method of claim 15, wherein the thermal adaptation of the thermally adaptive garment causes the thermally adaptive garment to increase insulation capability of the thermally adaptive garment in response to a decrease in temperature of an ambient environment that the thermally adaptive garment is present in.

17. A method of generating a coiled actuator fiber comprising:

twisting a fiber to generate a twisted fiber;

coiling the twisted fiber to generate a coiled fiber; and setting the coiled fiber by heat or chemical treatment to generate a coiled actuator fiber, wherein the coiled actuator fiber comprises a thermal expansion coefficient having a magnitude of 2 mm/m/° C. or more, and wherein the coiled actuator fiber defines space between neighboring coils of the coiled actuator fiber such that thermal actuation of the coiled fiber actuator brings the neighboring coils into contact with each other above 10° C.

18. The method of claim 17, wherein the coiled fiber is physically constrained during the setting such that a temperature change during the setting does not physically bring the neighboring coils into contact with each other based on the physical constraint of the neighboring coils.

19. A method of generating a coiled actuator fiber comprising:

generating a coiled actuator fiber having coils that define physical space between the coils when:

a. the coiled actuator fiber is at 27.0° C. and b. is unloaded, and setting the coiled fiber actuator by at least one of either:

a. heat or b. chemical treatment, while the coiled actuator fiber is under physical constraint that prevents actuation of the coiled actuator fiber during the setting.

20. The method of claim 19, wherein the physical constraint is provided by a core yarn or fiber that prevents actuation of the coiled actuator fiber during the setting.

* * * * *